US007628592B2

(12) United States Patent
Okamoto et al.

(10) Patent No.: US 7,628,592 B2
(45) Date of Patent: Dec. 8, 2009

(54) FLUID MACHINE HAVING REDUCED HEAT INPUT TO FLUID

(75) Inventors: Tetsuya Okamoto, Osaka (JP); Eiji Kumakura, Osaka (JP); Masakazu Okamoto, Osaka (JP); Michio Moriwaki, Osaka (JP); Katsumi Sakitani, Osaka (JP)

(73) Assignee: Daikin Industries, Ltd., Osaka-shi, Osaka (JP)

( * ) Notice: Subject to any disclaimer, the term of this patent is extended or adjusted under 35 U.S.C. 154(b) by 477 days.

(21) Appl. No.: 10/592,803

(22) PCT Filed: Mar. 9, 2005

(86) PCT No.: PCT/JP2005/004087

§ 371 (c)(1),
(2), (4) Date: Sep. 14, 2006

(87) PCT Pub. No.: WO2005/088078

PCT Pub. Date: Sep. 22, 2005

(65) Prior Publication Data

US 2008/0232992 A1 Sep. 25, 2008

(30) Foreign Application Priority Data

Mar. 17, 2004 (JP) ..... 2004-075711
Nov. 12, 2004 (JP) ..... 2004-329196

(51) Int. Cl.
*F01C 1/30* (2006.01)
*F03C 2/00* (2006.01)
*F04C 18/00* (2006.01)

(52) U.S. Cl. ..... 418/3; 418/11; 418/60; 418/94; 418/102

(58) Field of Classification Search ..... 418/3, 418/11, 15, 58, 60, 65, 94, 100, 102
See application file for complete search history.

(56) References Cited

FOREIGN PATENT DOCUMENTS

| | | | |
|---|---|---|---|
| JP | 4-124486 | A | 4/1992 |
| JP | 4-143489 | A | 5/1992 |
| JP | 6-081794 | A | 3/1994 |
| JP | 9-088511 | A | 3/1997 |
| JP | 2002-089472 | A | 3/2002 |
| JP | 2002-161885 | A | 6/2002 |
| JP | 2003-139059 | A | 5/2003 |
| JP | 2003-172244 | A | 6/2003 |
| JP | 2004-044569 | A | 2/2004 |

*Primary Examiner*—Theresa Trieu
(74) *Attorney, Agent, or Firm*—Birch, Stewart, Kolasch & Birch, LLP

(57) ABSTRACT

In a compression/expansion unit (30) serving as a fluid machine, both a compression mechanism (50) and an expansion mechanism (60) are housed in a single casing (31). An oil supply passageway (90) is formed in a shaft (40) by which the compression mechanism (50) and the expansion mechanism (60) are coupled together. Refrigeration oil accumulated in the bottom of the casing (31) is drawn up into the oil supply passageway (90) and is supplied to the compression mechanism (50) and to the expansion mechanism (60). Surplus refrigeration oil, which is supplied to neither of the compression and expansion mechanisms (50) and (60), is discharged out of the terminating end of the oil supply passageway (90) which opens at the upper end of the shaft (40). Thereafter, the surplus refrigeration oil flows into an oil return pipe (102) from a lead-out hole (101) and is returned back towards a second space (39). This reduces the amount of heat input to the fluid flowing through the expansion mechanism from the surplus refrigeration oil which has not been utilized to lubricate the compression and expansion mechanisms.

12 Claims, 11 Drawing Sheets

FLUID MACHINE HAVING REDUCED HEAT INPUT TO FLUID

This application is the national phase application under 35 U.S.C. § 371 of PCT International Application No. PCT/JP2005/004087, which has an International filing date of Mar. 9, 2005, designating the United States of America, and claims priority of Japanese Application Nos. JP 2004-075711 and JP 2004-329196, filed Mar. 17, 2004 and Nov. 12, 2004, respectively.

TECHNICAL FIELD

The present invention relates to an expander adapted to produce power by the expansion of high-pressure fluid.

BACKGROUND ART

A fluid machine, in which an expansion mechanism, an electric motor, and an expansion mechanism are coupled by a single rotating shaft, has been known in the conventional technology. In this fluid machine, power is produced by the expansion of fluid introduced into the expansion mechanism. Along with power produced by the electric motor, power produced in the expander is transmitted by the rotating shaft to the compression mechanism. Then, the compression mechanism is driven by both the power transmitted from the expansion mechanism and the power transmitted from the electric motor, and draws in and compresses fluids.

Patent Document I discloses a fluid machine of the type as described above. Referring to FIG. 6 of Patent Document I, there is shown a fluid machine whose vertically long, cylinder-shaped casing houses therein an expansion mechanism, an electric motor, a compression mechanism, and a rotating shaft. In the inside of the casing of the fluid machine, the expansion mechanism, the electric motor, the compression mechanism are arranged in the bottom-to-top order, and they are coupled together by the rotating shaft. In addition, both the expansion mechanism and the compression mechanism are formed by rotary fluid machines.

The fluid machine disclosed in Patent Document I is incorporated into an air conditioner which performs a refrigeration cycle. Low-pressure refrigerant at about 5 degrees Centigrade is drawn into the compression mechanism from the evaporator. The low-pressure refrigerant is compressed and becomes a high-pressure refrigerant of about 90 degrees Centigrade, and the high-pressure refrigerant is expelled from the compression mechanism. The high-pressure refrigerant expelled out of the compression mechanism passes through the internal space of the casing and then through a discharge pipe, and is discharged to the outside of the casing. On the other hand, high-pressure refrigerant at about 30 degrees Centigrade is introduced into the expansion mechanism from the gas cooler. The high-pressure refrigerant is expanded and becomes a low-pressure refrigerant of about 0 degrees Centigrade. The low-pressure refrigerant is delivered to the evaporator.

This type of vertical fluid machine often employs a structure in which lubricating oil accumulated in the bottom of the casing is supplied to the compression mechanism and to the expansion mechanism. When employing such a configuration, an oil supply passage is formed in the rotating shaft. Lubricating oil accumulated in the casing bottom is drawn into the oil supply passageway from the lower end of the rotating shaft by centrifugal pump action et cetera. And, lubricating oil flowing through the oil supply passageway is supplied to the compression and expansion mechanisms and is used to provide lubrication between members.

As described above, fluid compressed in the compression mechanism is often increased in temperature to relatively high-temperature levels. For this reason, in a fluid machine which is constructed such that fluid discharged from the compression mechanism flows through the inside of the casing, the temperature of lubricating oil accumulated in the casing bottom is also increased to relatively high-temperature levels. Accordingly, in fluid machines having such a structure, relatively high-temperature lubricating oil is supplied, through the oil supply passageway, to the compression mechanism and to the expansion mechanism.

Patent Document I: JP 2003-172244A

DISCLOSURE OF THE INVENTION

Problems that the Invention Intends to Solve

Here, in the compression and expansion mechanisms of the above-described fluid machine, the required amount of lubricating oil varies depending on the operation state such as rotation speed et cetera. In view of this, in the fluid machine, the flow rate of lubricating oil drawn into the oil supply passageway is set rather high so that in any operation state sufficient amounts of lubricating oil are supplied to the compression mechanism and to the expansion mechanism.

For the above case, since only a part of the lubricating oil drawn into the oil supply passageway is utilized to provide lubrication to the compression and expansion mechanisms, this necessitates bringing surplus lubricating oil, supplied to neither of the compression and expansion mechanisms, back to the casing bottom. To this end, it is conceivable to employ a structure in which the terminating end of the oil supply passageway is opened at the upper end surface of the rotating shaft so that surplus lubricating oil is discharged therefrom. For the case of employing such a structure, surplus lubricating oil overflowing from the terminating end of the oil supply passageway runs down to the casing bottom along the surface of the expansion mechanism.

However, in a fluid machine which is constructed such that fluid discharged from the compression mechanism flows in the casing, the temperature of lubricating oil which is taken into the oil supply passageway becomes high and the temperature of surplus lubricating oil overflowing from the terminating end of the oil supply passageway also becomes relatively high. Consequently, if surplus lubricating oil lingers on the surface of the expansion mechanism through which relatively low-temperature fluid passes over a long period of time, this produces the problem of increasing the amount of heat transfer from the surplus lubricating oil to the fluid in the expansion mechanism. Especially when employing the foregoing fluid machine for example in an air conditioner that performs a refrigeration cycle, the enthalpy of refrigerant which is delivered to the evaporator from the expansion mechanism increases, therefore causing a drop in refrigeration capacity, and the resulting adverse effects are serious.

With the above problem in mind, the present invention was made. Accordingly, an object of the present invention is to reduce the amount of heat input to fluid flowing through the expansion mechanism from surplus lubricating oil which has not been used to lubricate the compression and expansion mechanisms.

Means for Solving the Problem

A first aspect of the present invention provides a fluid machine in which: an expansion mechanism (60) for producing power by the expansion of fluid, a compression mechanism (50) for compressing fluid, and a rotating shaft (40) for transmitting power produced in the expansion mechanism (60) to the compression mechanism (50) are housed in a container-shaped casing (31); and fluid discharged from the compression mechanism (50) is fed to the outside of the casing (31) by way of an internal space defined in the casing (31). In the fluid machine of the first aspect of the present invention, lubricating oil is stored on the side of the compression mechanism (50) in the inside of the casing (31); and the fluid machine comprises: an oil supply passageway (90) which is formed in the rotating shaft (40) and which supplies lubricating oil stored in the inside of the casing (31) to the expansion mechanism (60) and has a terminating end from which surplus lubricating oil is discharged; and an oil return passageway (100) for guiding the surplus lubricating oil towards the compression mechanism (50) from the terminating end of the oil supply passageway (90).

A second aspect of the present invention provides a fluid machine in which: an expansion mechanism (60) for producing power by the expansion of fluid, a compression mechanism (50) for compressing fluid, and a rotating shaft (40) for transmitting power produced in the expansion mechanism (60) to the compression mechanism (50) are housed in a container-shaped casing (31); the inside of the casing (31) is divided into a first space (38) in which the expansion mechanism (60) is disposed and a second space (39) in which the compression mechanism (50) is disposed; and fluid discharged from the compression mechanism (50) is fed to the outside of the casing (31) by way of the second space (39). In the fluid machine of the second aspect of the present invention, the fluid machine comprises: an oil supply passageway (90) which is formed in the rotating shaft (40) and which supplies lubricating oil stored in the second space (39) to the expansion mechanism (60) and has a terminating end from which surplus lubricating oil is discharged; and an oil return passageway (100) for guiding the surplus lubricating oil towards the second space (39) from the terminating end of the oil supply passageway (90).

A third aspect of the present invention provides a fluid machine according to either the first aspect of the present invention or the second aspect of the present invention which is characterized in that a heat exchange means (120) for effecting heat transfer between lubricating oil in the oil supply passageway (90) and lubricating oil in the oil return passageway (100) is provided.

A fourth aspect of the present invention provides a fluid machine according to either the first aspect of the present invention or the second aspect of the present invention which is characterized in that along the oil supply passageway (90) the oil return passageway (100) is formed in the rotating shaft (40).

A fifth aspect of the present invention provides a fluid machine according to either the first aspect of the present invention or the second aspect of the present invention which is characterized in that the oil return passageway (100) is fluidly connected at its terminating end to the oil supply passageway (90).

A sixth aspect of the present invention provides a fluid machine according to either the first aspect of the present invention or the second aspect of the present invention which is characterized in that the expansion mechanism (60) is formed by a rotary expander which comprises a cylinder (71, 81) whose both ends are blocked, a piston (75, 85) for forming a fluid chamber (72, 82) within the cylinder (71, 81), and a blade (76, 86) for dividing the fluid chamber (72, 82) into a high-pressure side and a low-pressure side; the cylinder (71, 81) is provided with a through-hole (78, 88) which extends completely through the cylinder (71, 81) in a thickness direction thereof and into which the blade (76, 86) is inserted; and the through-hole (78, 88) of the cylinder (71, 81) constitutes a part of the oil return passageway (100).

A seventh aspect of the present invention provides a fluid machine according to either the first aspect of the present invention or the second aspect of the present invention which is characterized in that the casing (31) is provided with a discharge pipe (36) through which fluid discharged from the compression mechanism (50) is led out to the outside of the casing (31); and the oil return passageway (100) has a terminating end which is so positioned as to inhibit lubricating oil leaving the terminating end from flowing into the discharge pipe (36).

An eighth aspect of the present invention provides a fluid machine according to either the first aspect of the present invention or the second aspect of the present invention which is characterized in that in the inside of the casing (31) the expansion mechanism (60) is arranged above the compression mechanism (50); a discharge pipe (36), through which fluid discharged from the compression mechanism (50) is led out to the outside of the casing (31), is arranged between the compression mechanism (50) and the expansion mechanism (60) in the casing (31); and the oil return passageway (100) has a terminating end which is positioned below a starting end of the discharge pipe (36).

A ninth aspect of the present invention provides a fluid machine according to either the first aspect of the present invention or the second aspect of the present invention which is characterized in that an electric motor (45), coupled to the rotating shaft (40) to drive the compression mechanism (50), is arranged between the compression mechanism (50) and the expansion mechanism (60) in the casing (31); a discharge pipe (36), through which fluid discharged from the compression mechanism (50) is led out to the outside of the casing (31), is arranged between the electric motor (45) and the expansion mechanism (60) in the casing (31); and the oil return passageway (100) has a terminating end which is positioned in a clearance defined between a core cut part (48) formed in the outer periphery of a stator (46) of the electric motor (45) and the casing (31).

A tenth aspect of the present invention provides a fluid machine according to the second aspect of the present invention which is characterized in that the casing (31) is provided with a discharge pipe (36) through which fluid discharged from the compression mechanism (50) is led out to the outside of the casing (31) from the second space (39); and the oil return passageway (100) has a terminating end which is so positioned as to inhibit lubricating oil leaving the terminating end from flowing into the discharge pipe (36).

An eleventh aspect of the present invention provides a fluid machine according to the second aspect of the present invention which is characterized in that in the inside of the casing (31) the expansion mechanism (60) is arranged above the compression mechanism (50); a discharge pipe (36), through which fluid discharged from the compression mechanism (50) is led out to the outside of the casing (31) from the second space (39), is arranged between the compression mechanism (50) and the expansion mechanism (60) in the casing (31); and the oil return passageway (100) has a terminating end which is positioned below a starting end of the discharge pipe (36).

A twelfth aspect of the present invention provides a fluid machine according to the second aspect of the present invention which is characterized in that an electric motor (45), coupled to the rotating shaft (40) to drive the compression mechanism (50), is arranged between the compression mechanism (50) and the expansion mechanism (60) in the casing (31); a discharge pipe (36), through which fluid discharged from the compression mechanism (50) is led out to the outside of the casing (31) from the second space (39), is arranged between the electric motor (45) and the expansion mechanism (60) in the casing (31); and the oil return passageway (100) has a terminating end which is positioned in a clearance defined between a core cut part (48) formed in the outer periphery of a stator (46) of the electric motor (45) and the casing (31).

Working Operation

In the first aspect of the present invention, both the expansion mechanism (60) and the compression mechanism (50) are housed in the casing (31) of the fluid machine (30). Fluid compressed by the compression mechanism (50) is discharged into an internal space defined within the casing (31). Thereafter, the fluid is delivered to the outside of the casing (31). In the internal space of the casing (31), lubricating oil is stored on the side of the compression mechanism (50). In other words, fluid discharged from the compression mechanism (50) and lubricating oil exist in the internal space of the casing (31). The lubricating oil stored in the inside of the casing (31) is being in a relatively high-temperature, high-pressure state associated with the temperature and pressure of the fluid discharged from the compression mechanism (50).

In the fluid machine (30) of this aspect, power produced by fluid expansion in the expansion mechanism (60) is transmitted by the rotating shaft (40) to the compression mechanism (50). The oil supply passageway (90) is formed in the rotating shaft (40). Lubrication oil stored on the side of the compression mechanism (50) in the inside of the casing (31) is supplied, through the oil supply passageway (90), to the expansion mechanism (60), while surplus lubricating oil is discharged from the terminating end of the oil supply passageway (90). The surplus lubricating oil flows into the oil return passageway (100) from the terminating end of the oil supply passageway (90) and is returned back towards the compression mechanism (50) by way of the oil return passageway (100). In other words, the surplus lubricating oil is rapidly discharged towards the compression mechanism (50) by the oil return passageway (100). And, in comparison with the case where surplus lubricating oil flows along the surface of the expansion mechanism (60), the length of time for which surplus lubricating oil is in contact with the expansion mechanism (60) becomes shorter and the amount of heat transfer to the expansion mechanism (60) from surplus lubricating oil becomes reduced.

In the second aspect of the present invention, both the expansion mechanism (60) and the compression mechanism (50) are housed in the casing (31) of the fluid machine (30). The inside of the casing (31) is divided into the first space (38) in which the expansion mechanism (60) is arranged and the second space (39) in which the compression mechanism (50) is arranged. Fluid compressed by the compression mechanism (50) is expelled to the second space (39) of the casing (31) and is delivered to the outside of the casing (31) by way of the second space (39). There is no need to provide a gas tight partition between the first space (38) and the second space (39) in the inside of the casing (31). It does not matter even if the first space (38) and the second space (39) have the same pressure. Lubricating oil is stored in the second space (39). The lubricating oil stored in the second space (39) is being in a relatively high-temperature, high-pressure state associated with the temperature and pressure of the fluid discharged from the compression mechanism (50).

In the fluid machine (30) of this aspect, power produced by fluid expansion in the expansion mechanism (60) is transmitted by the rotating shaft (40) to the compression mechanism (50). The oil supply passageway (90) is formed in the rotating shaft (40). Lubrication oil stored in the second space (39) is supplied, through the oil supply passageway (90), to the expansion mechanism (60), while surplus lubricating oil is discharged from the terminating end of the oil supply passageway (90). The surplus lubricating oil flows into the oil return passageway (100) from the terminating end of the oil supply passageway (90) and is returned back towards the second space (39) by way of the oil return passageway (100). In other words, the surplus lubricating oil is rapidly discharged towards the second space (39) by the oil return passageway (100). And, in comparison with the case where surplus lubricating oil flows along the surface of the expansion mechanism (60), the length of time for which surplus lubricating oil is in contact with the expansion mechanism (60) becomes shorter and the amount of heat transfer to the expansion mechanism (60) from the surplus lubricating oil becomes reduced.

In the third aspect of the present invention, the fluid machine (30) is provided with the heat exchange means (120). In the heat exchange means (120), heat transfer takes place between lubricating oil which is supplied to the expansion mechanism (60) by way of the oil supply passageway (90) and surplus lubricating oil which has been returned back from the expansion mechanism's (60) side by way of the oil return passageway (100). Since the expansion mechanism (60) is being at a relatively low temperature, the temperature of the surplus lubricating oil flowing through the oil return passageway (100) is lower than the temperature of the lubricating oil taken into the oil supply passageway (90) from the internal space of the casing (31). Consequently, in the heat exchange means (120), the lubricating oil in the oil supply passageway (90) is cooled by the lubricating oil in the oil return passageway (100). In other words, the temperature of lubricating oil which is supplied to the expansion mechanism (60) from the oil supply passageway (90) falls.

In the fourth aspect of the present invention, both the oil return passageway (100) and the oil supply passageway (90) are formed in the single rotating shaft (40). In the rotating shaft (40), the oil return passageway (100) and the oil supply passageway (90) are in close proximity with each other, and heat transfer takes place between the lubricating oil in the oil supply passageway (90) and the lubricating oil in the oil return passageway (100). As described above, the surplus lubricating oil flowing through the oil return passageway (100) is lower in temperature than the lubricating oil taken into the oil supply passageway (90) from the internal space of the casing (31). Consequently, the lubricating oil in the oil supply passageway (90) cooled by the lubricating oil in the oil return passageway (100) is supplied to the expansion mechanism (60).

In the fifth aspect of the present invention, the terminating end of the oil return passageway (100) is fluidly connected to the oil supply passageway (90). A mixture of the lubricating oil taken from the internal space of the casing (31) and the surplus lubricating oil from the oil return passageway (100) is supplied to the expansion mechanism (60). As described above, the surplus lubricating oil flowing through the oil return passageway (100) is lower in temperature than the lubricating oil in the oil supply passageway (90) taken from the internal space of the casing (31). Therefore, the temperature of lubricating oil which is supplied to the expansion mechanism (60) from the oil supply passageway (90) falls when mixed with lubricating oil from the oil return passageway (100).

In the sixth aspect of the present invention, the expansion mechanism (60) is formed by a rotary expander. The rotary expander that constitutes the expansion mechanism (60) may be of the swinging piston type in which the blade (76, 86) and the piston (75, 85) are integrally formed with each other or may be of the rolling piston type in which the blade (76, 86) is formed as a separate body from the piston (75, 85). The through-hole (78, 88) is formed in the cylinder (71, 81) and the blade (76, 86) is inserted into the through-hole (78, 88). The through-hole (78, 88) is formed oversized in order to permit movement of the blade (76, 86). And the through-hole (78, 88) forms a part of the oil return passageway (100) and surplus lubricating oil passes through the through-hole (78, 88).

In the seventh aspect of the present invention, the casing (31) is provided with the discharge pipe (36). Fluid discharged to the internal space of the casing (31) from the compression mechanism (50) is delivered to the outside of the casing (31) by way of the discharge pipe (36). Here, if the terminating end of the oil return passageway (100) is located near the starting end of the discharge pipe (36), this may result in a reduction in the amount of lubricating oil stored in the internal space of the casing (31) because lubricating oil leaving the oil return passageway (100) flows into the discharge pipe (36) along with fluid discharged from the compression mechanism (50) and is then discharged from the casing (31). To cope with this, in this aspect, the terminating end of the oil return passageway (100) is so positioned as to inhibit lubricating oil leaving the oil return passageway (100) from entering the discharge pipe (36), thereby securing the storage amount of lubricating oil in the casing (31).

In the eighth aspect of the present invention, the compression mechanism (50) and the expansion mechanism (60) are vertically arranged in the inside of the casing (31). The discharge pipe (36) is arranged between the compression mechanism (50) and the expansion mechanism (60) in the casing (31), in other words the discharge pipe (36) overlies the compression mechanism (50) but underlies the expansion mechanism (60) in the casing 31. Fluid discharged from the compression mechanism (50) flows upwards in the internal space of the casing (31) and is delivered to the outside of the casing (31) by way of the discharge pipe (36). On the other hand, the terminating end of the oil return passageway (100) is positioned below the discharge pipe (36). As a result of such arrangement, very little lubricating oil flows upwards and enters the discharge pipe (36) after leaving the oil return passageway (100), and even if there exists such a lubricating oil, the amount thereof is negligible.

In the ninth aspect of the present invention, the electric motor (45) is arranged between the compression mechanism (50) and the expansion mechanism (60) in the inside of the casing (31). The electric motor (45) is coupled to the rotating shaft (40) and drives the compression mechanism (50) together with the expansion mechanism (60). The discharge pipe (36) is arranged between the electric motor (45) and the expansion mechanism (60) in the casing (31), in other words the discharge pipe (36) is located nearer to the expansion mechanism (60) than to the electric motor (45). Fluid discharged to the internal space of the casing (31) from the compression mechanism (50) makes its way through a clearance defined in the electric motor (45) and is delivered to the outside of the casing (31) by way of the discharge pipe (36). The stator (46) of the electric motor (45) has the core cut part (48) formed by partially notching the outer periphery of the stator (46). The terminating end of the oil return passageway (100) is positioned in a clearance defined between the core cut part (48) of the stator (46) and the inner surface of the casing (31). Lubricating oil leaving the oil return passageway (100) flows through the clearance. Consequently, very little refrigeration oil enters the discharge pipe (36) after leaving the oil return passageway (100), and even if there exists such a refrigeration oil, the amount thereof is negligible.

In the tenth aspect of the present invention, the casing (31) is provided with the discharge pipe (36). Fluid discharged to the second space (39) from the compression mechanism (50) is delivered to the outside of the casing (31) by way of the discharge pipe (36). Here, if the terminating end of the oil return passageway (100) is located near the starting end of the discharge pipe (36), this may result in a reduction in the amount of lubricating oil stored in the second space (39) because lubricating oil leaving the oil return passageway (100) flows into the discharge pipe (36) along with fluid discharged from the compression mechanism (50) and is then discharged from the casing (31). To cope with this, in this aspect, the terminating end of the oil return passageway (100) is so positioned as to inhibit lubricating oil leaving the oil return passageway (100) from entering the discharge pipe (36), thereby securing the storage amount of lubricating oil in the second space (39).

In the eleventh aspect of the present invention, the compression mechanism (50) and the expansion mechanism (60) are vertically arranged in the inside of the casing (31). The discharge pipe (36) is arranged between the compression mechanism (50) and the expansion mechanism (60) in the casing (31), in other words the discharge pipe (36) overlies the compression mechanism (50) but underlies the expansion mechanism (60) in the casing (31). Fluid discharged from the compression mechanism (50) from the second space (39) flows upwards in the second space (39) and is delivered to the outside of the casing (31) by way of the discharge pipe (36). On the other hand, the terminating end of the oil return passageway (100) is positioned below the discharge pipe (36). As a result of such arrangement, very little refrigeration oil flows upwards and enters the discharge pipe (36) after leaving the oil return passageway (100), and even if there exists such a refrigeration oil, the amount thereof is negligible.

In the twelfth aspect of the present invention, the electric motor (45) is arranged between the compression mechanism (50) and the expansion mechanism (60) in the inside of the casing (31). The electric motor (45) is coupled to the rotating shaft (40) and drives the compression mechanism (50) together with the expansion mechanism (60). The discharge pipe (36) is arranged between the electric motor (45) and the expansion mechanism (60) in the casing (31), in other words the discharge pipe (36) is located nearer to the expansion mechanism (60) than to the electric motor (45). Fluid discharged to the second space (39) from the compression mechanism (50) makes its way through a clearance defined in the electric motor (45) and is delivered to the outside of the casing (31) by way of the discharge pipe (36). The stator (46) of the electric motor (45) has the core cut part (48) formed by partially notching the outer periphery of the stator (46). The terminating end of the oil return passageway (100) is positioned in a clearance defined between the core cut part (48) of the stator (46) and the inner surface of the casing (31). Lubricating oil leaving the oil return passageway (100) flows through the clearance. Consequently, very little refrigeration oil enters the discharge pipe (36) after leaving the oil return passageway (100), and even if there exists such a refrigeration oil, the amount thereof is negligible.

Effects of the Invention

In the fluid machine (30) of the first aspect of the present invention, surplus lubricating oil expelled from the oil supply passageway (90) of the rotating shaft (40) is introduced into the oil return passageway (100) from the terminating end of the oil supply passageway (90) and is then returned back towards the compression mechanism (50). To sum up, it is arranged in the first aspect of the present invention such that surplus lubricating oil is introduced into the oil return passageway (100) and is then rapidly delivered towards the compression mechanism (50). In addition, in the fluid machine (30) of the second aspect of the present invention, surplus lubricating oil expelled from the oil supply passageway (90) of the rotating shaft (40) is introduced into the oil return passageway (100) from the terminating end of the oil supply passageway (90) and is then returned back towards the second space (39). To sum up, it is arranged in the second aspect of the present invention such that surplus lubricating oil is introduced into the oil return passageway (100) and is then rapidly delivered towards the second space (39).

Therefore, in accordance with the present invention, in comparison with the case where surplus lubricating oil flows along the surface of the expansion mechanism (60), the length of time for which surplus lubricating oil is in contact with the expansion mechanism (60) can be made shorter and the amount of heat transfer to the expansion mechanism (60) from the surplus lubricating oil can be reduced.

In the third to fifth aspects of the present invention, by making utilization of lubricating oil in the oil return passageway (100) that has undergone a drop in temperature during its passage through the expansion mechanism (60), the temperature of lubricating oil which is supplied to the expansion mechanism (60) from the oil supply passageway (90) is made to fall. Therefore, in accordance with these aspects of the present invention, it becomes possible to reduce the difference in temperature between lubricating oil which is supplied to the expansion mechanism (60) from the oil supply passageway (90) and fluid which passes through the expansion mechanism (60), thereby making it possible to further cut down the amount of heat transfer to the fluid passing through the expansion mechanism from the lubricating oil.

In the sixth aspect of the present invention, a part of the oil return passageway (100) is formed by making utilization of the through-hole (78, 88) inevitably formed in the cylinder (71, 81) for mounting the blade (76, 86). Consequently, it becomes possible to inhibit the increase in machine work et cetera due to the provision of the oil return passageway (100), thereby making it possible to prevent the increase in manufacture cost of the fluid machine (30). In addition, it is possible to utilize surplus lubricating oil flowing through the oil return passageway (100) to provide lubrication to the blade (76, 86) et cetera and it also becomes possible to improve the reliability of the expansion mechanism (60).

In accordance with each of the seventh to twelfth aspects of the present invention, it becomes possible to reduce the amount of lubricating oil flowing to the outside of the casing (31) from the discharge pipe (36) along with fluid discharged from the compression mechanism (50). Consequently, it can be secured that lubricating oil is stored in a sufficient amount in the inside of the casing (31), and a sufficient amount of lubricating oil is supplied to the compression mechanism (50) and to the expansion mechanism (60), thereby forestalling the occurrence of troubles such as seizing et cetera.

REFERENCE NUMERALS IN THE DRAWINGS

Figure 1:
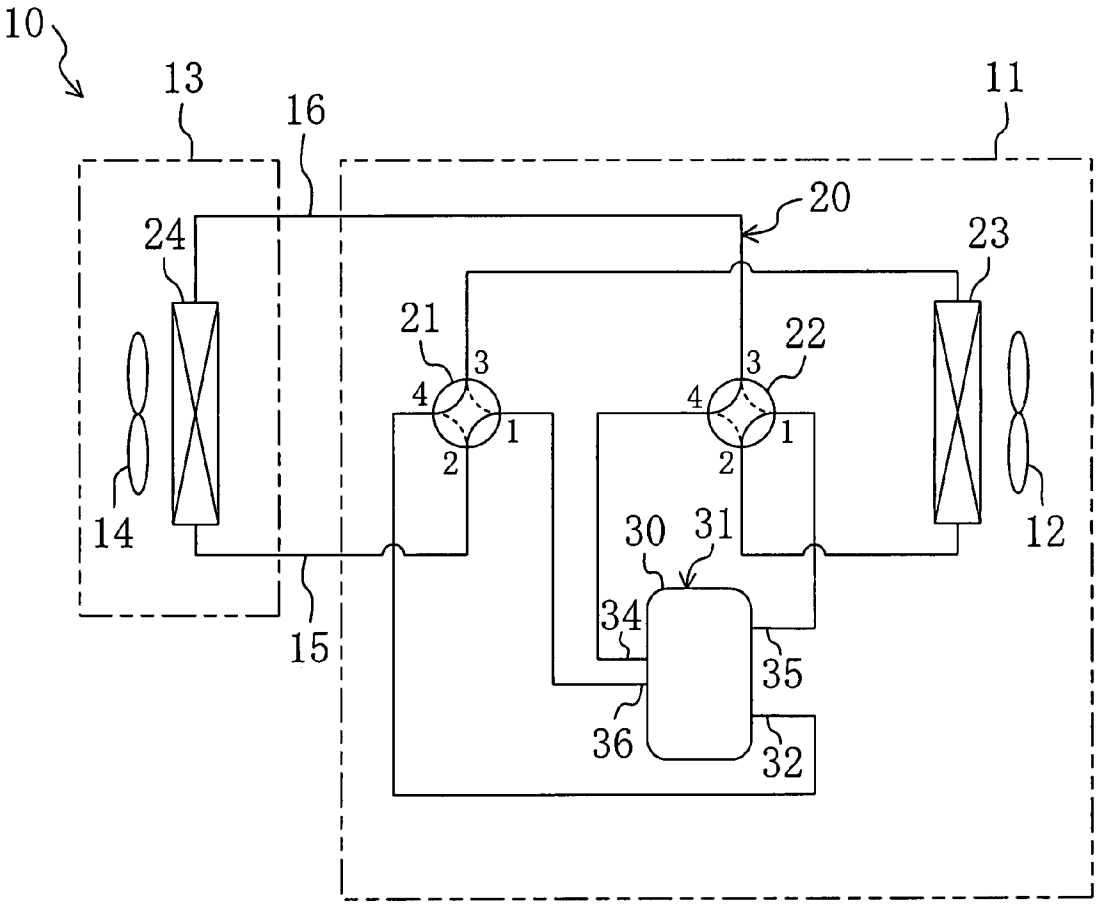
FIG. 1 is a piping system diagram of an air conditioner in a first embodiment of the present invention.

31: casing
36: discharge pipe
38: first space
39: second space
40: shaft (rotating shaft)
45: electric motor
46: stator
48: core cut part
50: compression mechanism
60: expansion mechanism
71: first cylinder
72: first fluid chamber
75: first piston
76: first blade
78: bush hole (through-hole)
81: second cylinder
82: second fluid chamber
85: second piston
86: second blade
88: bush hole (through-hole)
90: oil supply passageway
100: oil return passageway
120: heat exchanger (heat exchange means)

BEST MODE FOR CARRYING OUT THE INVENTION

In the following, embodiments of the present invention will be described in detail with reference to the drawing figures.

Embodiment 1

A first embodiment of the present invention is described. An air conditioner (10) of the present embodiment has a compression/expansion unit (30) which is a fluid machine relating to the present invention.

Overall Structure of the Air Conditioner

As shown in FIG. 1, the air conditioner (10) is of the so-called "separate type", and is made up of an outdoor unit (11) and an indoor unit (13). The outdoor unit (11) houses therein an outdoor fan (12), an outdoor heat exchanger (23), a first four way switching valve (21), a second four way switching valve (22), and a compression/expansion unit (30). On the other hand, the indoor unit (13) houses therein an indoor fan (14) and an indoor heat exchanger (24). The outdoor unit (11) is installed outside a building. The indoor unit (13) is installed inside the building. In addition, the outdoor unit (11) and the indoor unit (13) are connected together by a pair of interconnecting lines (15, 16). Details about the compression/expansion unit (30) will be described later.

The air conditioner (10) is equipped with a refrigerant circuit (20). The refrigerant circuit (20) is a closed circuit along which the compression/expansion unit (30), the indoor heat exchanger (24), and other components are provided. Additionally, the refrigerant circuit (20) is filled up with carbon dioxide ($CO_2$) as a refrigerant.

Both the outdoor heat exchanger (23) and the indoor heat exchanger (24) are fin and tube heat exchangers of the cross fin type. In the outdoor heat exchanger (23), refrigerant circulating in the refrigerant circuit (20) exchanges heat with outdoor air. In the indoor heat exchanger (24), refrigerant circulating in the refrigerant circuit (20) exchanges heat with indoor air.

The first four way switching valve (21) is provided with four ports. In the first four way switching valve (21), the first port is fluidly connected to a discharge pipe (36) of the compression/expansion unit (30); the second port is fluidly connected to one end of the indoor heat exchanger (24) via the interconnecting line (15); the third port is fluidly connected to one end of the outdoor heat exchanger (23); and the fourth port is fluidly connected to a suction port (32) of the compression/expansion unit (30). And, the first four way switching valve (21) is switchable between a first state that allows fluid communication between the first port and the second port and fluid communication between the third port and the fourth port (as indicated by the solid line in FIG. 1) and a second state that allows fluid communication between the first port and the third port and fluid communication between the second port and the fourth port (as indicated by the broken line in FIG. 1).

The second four way switching valve (22) is provided with four ports. In the second four way switching valve (22), the first port is fluidly connected to an outflow port (35) of the compression/expansion unit (30); the second port is fluidly connected to the other end of the outdoor heat exchanger (23); the third port is fluidly connected to the other end of the indoor heat exchanger (24) via the interconnecting line (16); and the fourth port is fluidly connected to an inflow port (34) of the compression/expansion unit (30). And, the second four way switching valve (22) is switchable between a first state that allows fluid communication between the first port and the second port and fluid communication between the third port and the fourth port (as indicated by the solid line in FIG. 1) and a second state that allows fluid communication between the first port and the third port and fluid communication between the second port and the fourth port (as indicated by the broken line in FIG. 1).

Structure of the Compression/Expansion Unit

Figure 2:
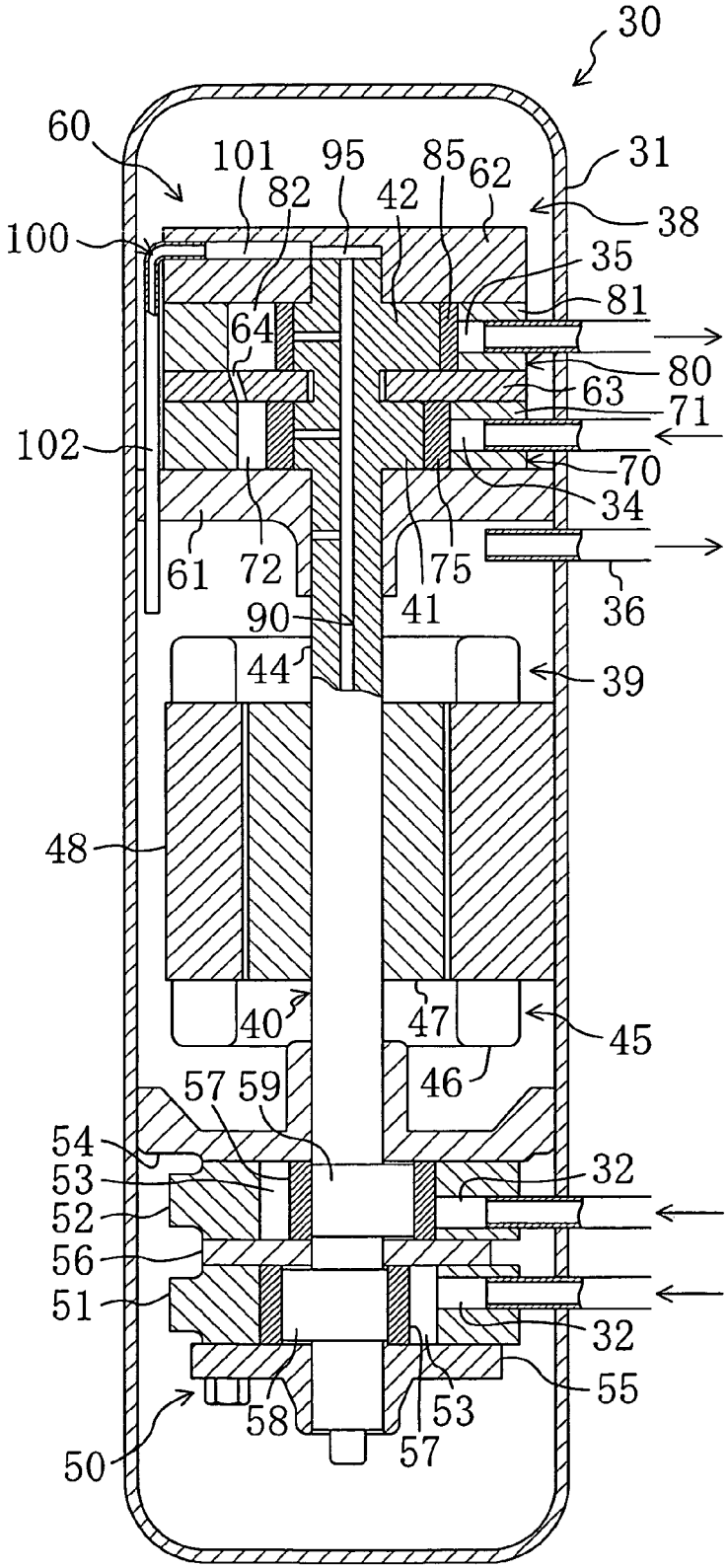
FIG. 2 is a schematic cross section view of a compression/expansion unit of the first embodiment.

As shown in FIG. 2, the compression/expansion unit (30) includes a casing (31) which is a vertically long, cylinder-shaped, hermitically-closed container. Arranged, in a bottom-to-top order, within the casing (31) are a compression mechanism (50), an electric motor (45), and an expansion mechanism (60). In addition, refrigeration oil (lubricating oil) is accumulated in the bottom of the casing (31). In other words, in the inside of the casing (31), the refrigeration oil is stored on the side of the compression mechanism (50).

The internal space of the casing (31) is vertically divided by the front head (61) of the expansion mechanism (60) into an upper space and a lower space. The upper space constitutes a first space (38), while the lower space constitutes a second space (39). The expansion mechanism (60) is arranged in the first space (38). The compression mechanism (50) and the electric motor (45) are arranged in the second space (39). The first space (38) and the second space (39) are not airtightly separated from each other, and the internal pressure of the first space (38) and the internal pressure of the second space (39) are approximately the same.

The discharge pipe (36) is attached to the casing (31). The discharge pipe (36) is arranged between the electric motor (45) and the expansion mechanism (60) and is brought into fluid communication with the second space (39) in the inside of the casing (31). In addition, the discharge pipe (36) is shaped like a relatively short straight pipe, and lies in an approximately horizontal orientation.

The electric motor (45) is disposed in a longitudinally central portion of the casing (31). The electric motor (45) is made up of a stator (46) and a rotor (47). The stator (46) is firmly secured to the casing (31) by shrinkage fitting or the like. The outer periphery of the stator (46) is partially notched to form a core cut part (48). There is defined a clearance between the core cut part (48) and the inner peripheral surface of the casing (31). The rotor (47) is disposed inside the stator (46). A main shaft part (44) of a shaft (40) is passed through the rotor (47) coaxially with the rotor (47).

The shaft (40) constitutes a rotating shaft. The shaft (40) is provided, at its lower end side, with two lower side eccentric parts (58, 59). In addition, the shaft (40) has, at its upper end side, two greater diameter eccentric parts (41, 42).

The two lower side eccentric parts (58, 59) are formed so as to be greater in diameter than the main shaft part (44), wherein the lower one constitutes a first lower side eccentric part (58) and the upper one constitutes a second lower side eccentric part (59). The first lower side eccentric part (58) and the second lower side eccentric part (59) are opposite to each other in eccentric direction relative to the center of axle of the main shaft part (44).

The two greater diameter eccentric parts (41, 42) are formed so as to be greater in diameter than the main shaft part (44), wherein the lower one constitutes a first greater diameter eccentric part (41) and the upper one constitutes a second greater diameter eccentric part (42). The first and second greater diameter eccentric parts (41, 42) are made eccentric in the same direction. The outer diameter of the second greater diameter eccentric part (42) is made greater than the outer diameter of the first greater diameter eccentric part (41). In addition, the amount of eccentricity relative to the center of axle of the main shaft part (44) of the second greater diameter eccentric part (42) is made greater than that of the first greater diameter eccentric part (41).

An oil supply passageway (90) is formed in the shaft (40). The oil supply passageway (90) has a starting end which opens at the lower end surface of the shaft (40), and a terminating end which opens at the upper end surface of the shaft (40). In addition, the oil supply passageway (90) includes a starting end portion that constitutes a centrifugal pump. The oil supply passageway (90) draws in refrigeration oil accumulated in the bottom of the casing (31) and then supplies the drawn-in refrigeration oil to the compression mechanism (50) and to the expansion mechanism (60).

The compression mechanism (50) constitutes a swinging piston type rotary compressor. The compressor mechanism (50) has two cylinders (51, 52) and two pistons (57). In the compression mechanism (50), a rear head (55), a first cylinder (51), an intermediate plate (56), a second cylinder (52), and a front head (54) are layered one upon the other in a bottom-to-top order.

The first and second cylinders (51, 52) each contain therein a respective cylinder-shaped piston, i.e. the piston (57). Although not shown diagrammatically in the figure, a flat plate-like blade is projectingly provided on the side surface of the piston (57). The blade is supported, through a swinging bush, on the cylinder (51, 52). The piston (57) within the first cylinder (51) engages with the first lower side eccentric part (58) of the shaft (40). On the other hand, the piston (57) within the second cylinder (52) engages with the second lower side eccentric part (59) of the shaft (40). The piston (57, 57) is, at its inner peripheral surface, in sliding contact with the outer peripheral surface of the lower side eccentric part (58, 59). In addition, the piston (57, 57) is, at its outer peripheral surface, in sliding contact with the inner peripheral surface of the cylinder (51, 52). And there is formed a compression chamber (53) between the outer peripheral surface of the piston (57, 57) and the inner peripheral surface of the cylinder (51, 52).

The first and second cylinders (51, 52) each have a respective suction port (33). The suction port (33) passes through the cylinder (51, 52) in the radial direction, with its terminating end opened at the inner peripheral surface of the cylinder (51, 52). In addition, each suction port (33) is extended to the outside of the casing (31) by piping.

The front and rear heads (54) and (55) are each provided with a respective discharge port. The discharge port of the front head (54) allows the compression chamber (53) within the second cylinder (52) to fluidly communicate with the second space (39). The discharge port of the rear head (55) allows the compression chamber (53) within the first cylinder (51) to fluidly communicate with the second space (39). In addition, each discharge port is provided, at its terminating end, with a respective discharge valve formed by a reed valve and is placed in the open or closed state by the discharge valve. Diagrammatical representation of these discharge ports and valves is omitted in FIG. 2. And gas refrigerant discharged into the second space (39) from the compression mechanism (50) is delivered out of the compression/expansion unit (30) by way of the discharge pipe (36).

As described above, the compression mechanism (50) is supplied with refrigeration oil from the oil supply passageway (90). Although not diagrammatically shown in the figure, passageways branched off from the oil supply passageway (90) are opened, respectively, at the outer peripheral surface of the lower side eccentric part (58, 59) and at the outer peripheral surface of the main shaft part (44), and refrigeration oil is supplied through the branch passageways to the sliding surfaces of the lower side eccentric part (58, 59) and the piston (57, 57), to the sliding surfaces of the main shaft part (44) and the front head (54), or to the sliding surfaces of the main shaft part (44) and the rear head (55).

Figure 3:
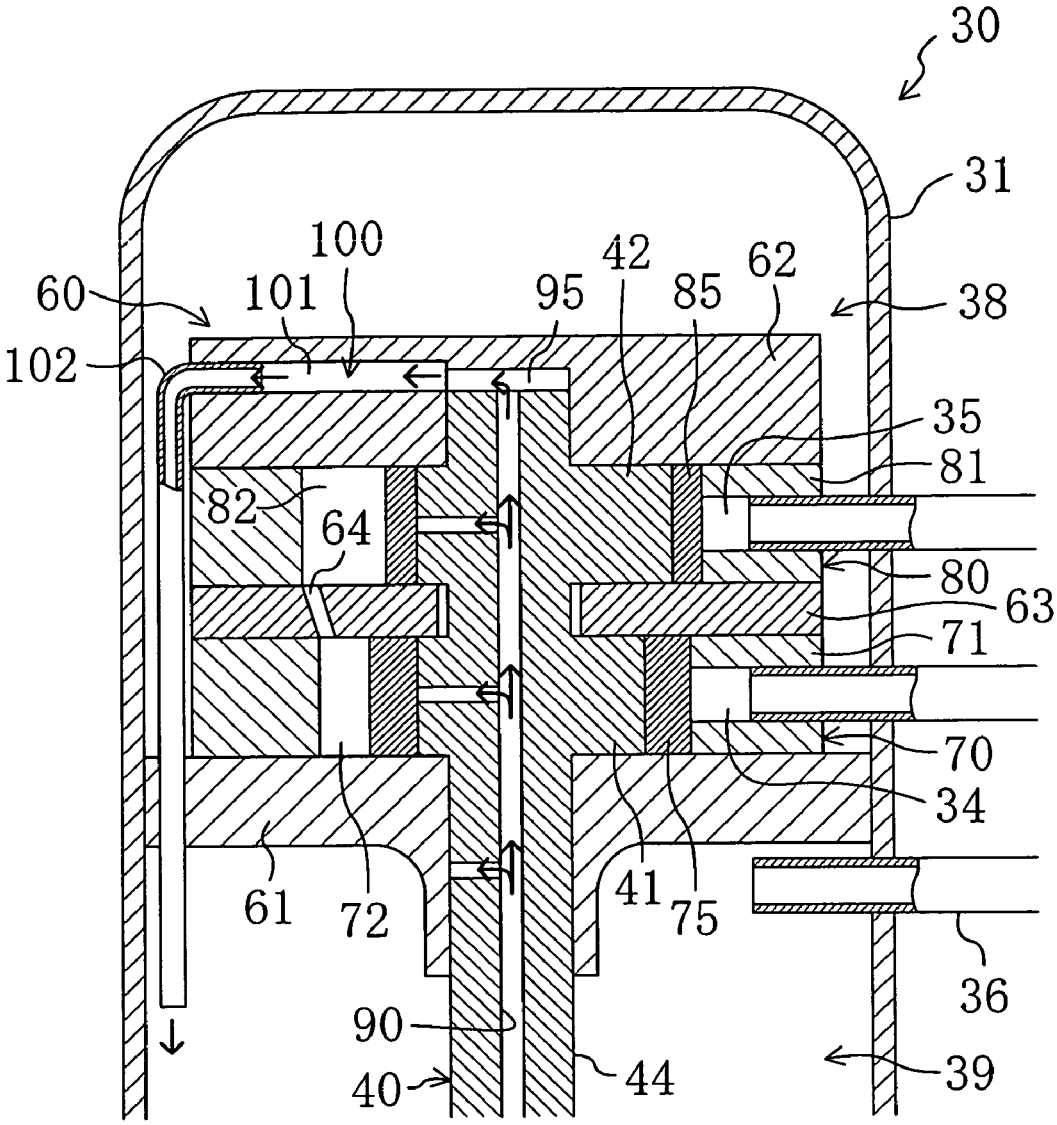
FIG. 3 is an enlarged cross section view which illustrates a main section of an expansion mechanism part of the first embodiment.

As also shown in FIG. 3, the expansion mechanism (60) is formed by a so-called swinging piston type fluid machine. The expansion mechanism (60) is provided with two pair combinations of cylinders (71, 81) and pistons (75, 85). In addition, the expansion mechanism (60) further includes a front head (61), an intermediate plate (63), and a rear head (62).

In the expansion mechanism (60), the front head (61), the first cylinder (71), the intermediate plate (63), the second cylinder (81), and the rear head (62) are layered one upon the other in a bottom-to-top order. In this state, the lower end surface of the first cylinder (71) is blocked by the front head (61) and the upper end surface of the first cylinder (71) is blocked by the intermediate plate (63). On the other hand, the lower end surface of the second cylinder (81) is blocked by the intermediate plate (63) and the upper end surface of the second cylinder (81) is blocked by the rear head (62). In addition, the inside diameter of the second cylinder (81) is greater than the inside diameter of the first cylinder (71).

The shaft (40) is passed through the front head (61), the first cylinder (71), the intermediate plate (63), and the second cylinder (81) which are arranged one upon the other in a layered manner. The upper end part of the shaft (40) is inserted into a hole with a bottom formed in the rear head (62). Formed between the bottom surface of the hole (the upper surface in FIG. 2) and the upper end surface of the shaft (40) is an end space (95). Additionally, the first greater diameter eccentric part (41) of the shaft (40) lies within the first cylinder (71) while on the other hand the second greater diameter eccentric part (42) of the shaft (40) lies within the second cylinder (81).

Figure 4:
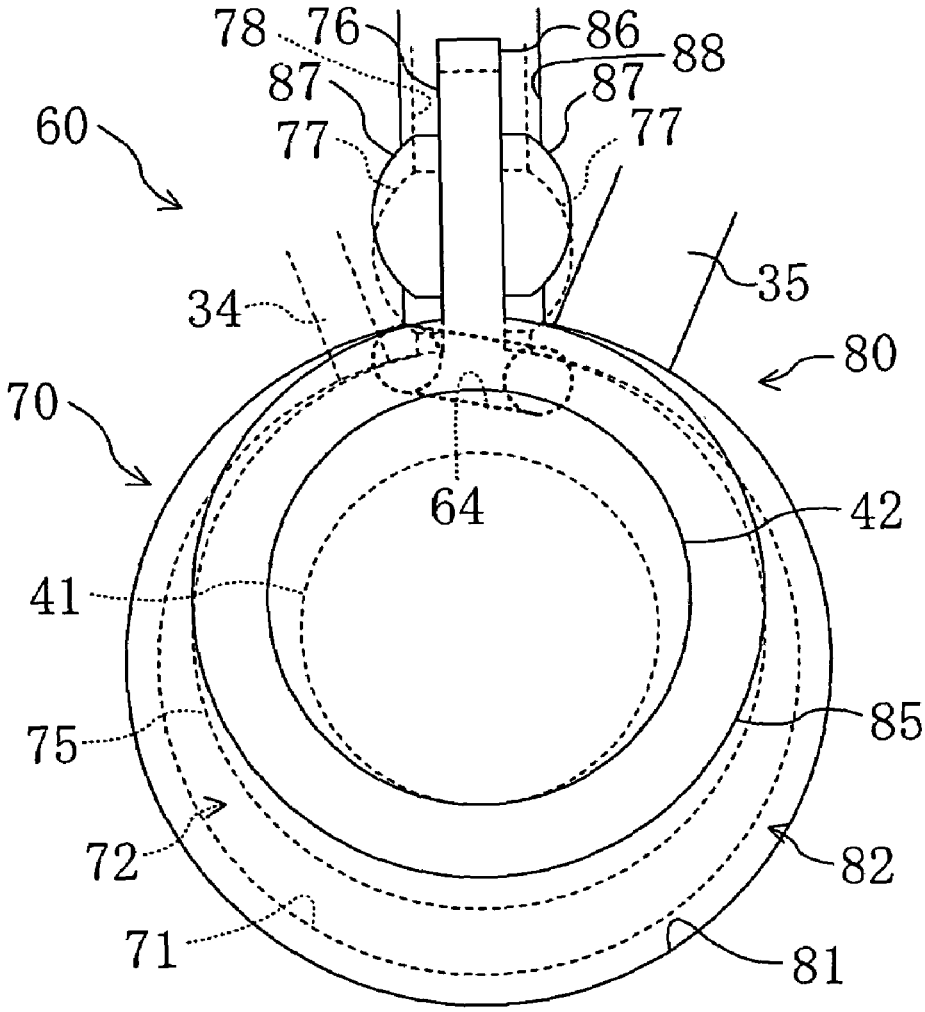
FIG. 4 is a diagram which illustrates in an enlarged manner a main section of the expansion mechanism part of the first embodiment.
Figure 5:
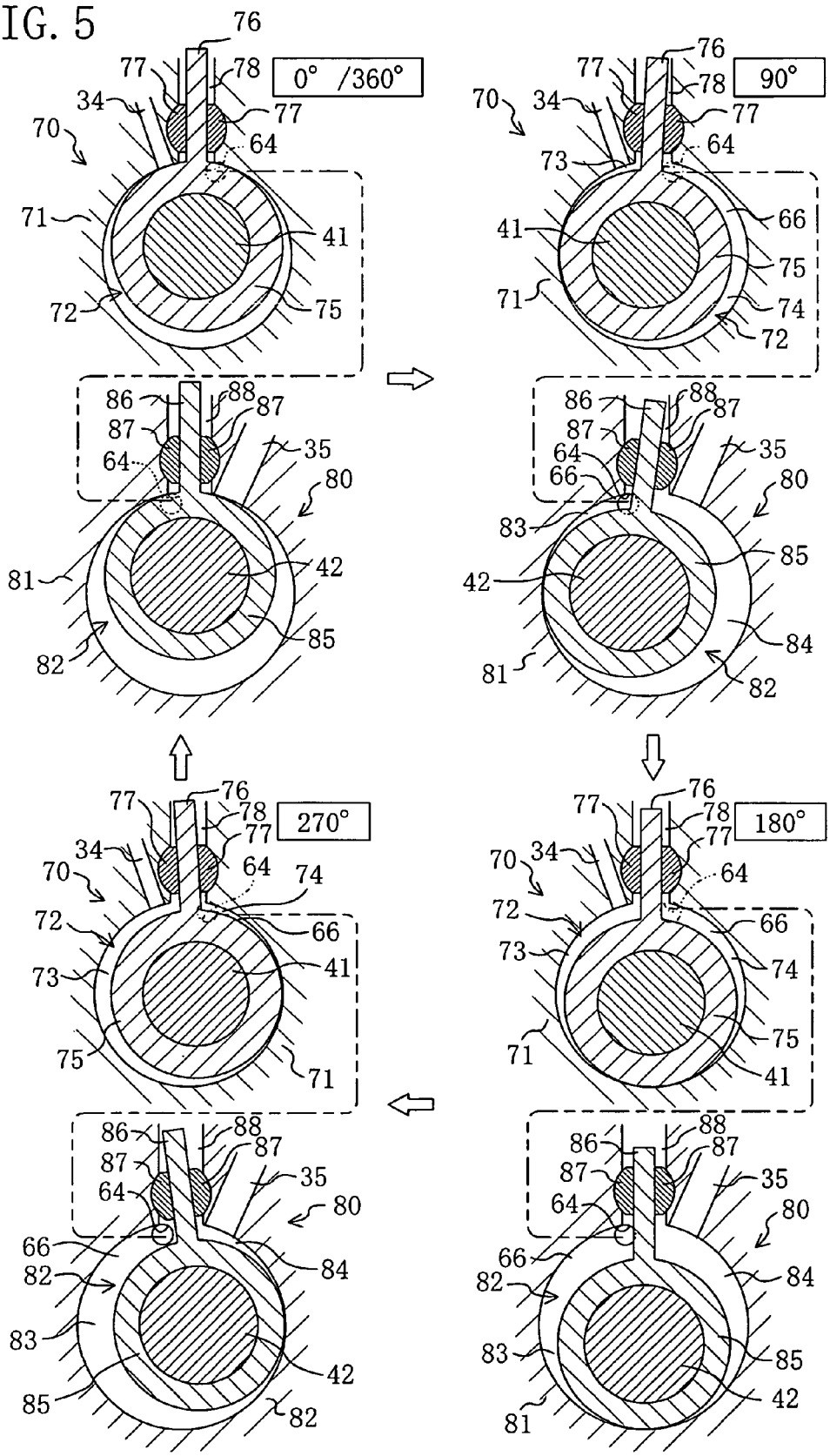
FIG. 5 is a diagram which illustrates in cross section states of each rotary mechanism part for each 90 degrees of the rotation angle of a shaft in the expansion mechanism part of the first embodiment.

As shown in FIG. 4 and FIG. 5, the first piston (75) is mounted within the first cylinder (71) and the second piston (85) is mounted within the second cylinder (81). The first and second pistons (75, 85) are each shaped like a circular ring or like a cylinder. The first piston (75) and the second piston (85) are the same in outside diameter. The inside diameter of the first piston (75) approximately equals the outside diameter of the first greater diameter eccentric part (41). The inside diameter of the second piston (85) approximately equals the outside diameter of the second greater diameter eccentric part (42). And, the first greater diameter eccentric part (41) is passed through the first piston (75) and the second greater diameter eccentric part (42) is passed through the second piston (85).

The first piston (75) is, at its outer peripheral surface, in sliding contact with the inner peripheral surface of the first cylinder (71). One end surface of the first piston (75) is in sliding contact with the front head (61). The other end surface of the first piston (75) is in sliding contact with the intermediate plate (63). Within the first cylinder (71), a first fluid chamber (72) is formed between the inner peripheral surface of the first cylinder (71) and the outer peripheral surface of the first piston (75). On the other hand, the second piston (85) is, at its outer peripheral surface, in sliding contact with the inner peripheral surface of the second cylinder (81). One end surface of the second piston (85) is in sliding contact with the rear head (62). The other end surface of the second piston (85) is in sliding contact with the intermediate plate (63). Within the second cylinder (81), a second fluid chamber (82) is formed between the inner peripheral surface of the second cylinder (81) and the outer peripheral surface of the second piston (85).

The first and second piston (75, 85) are each provided with an integrally formed blade (76, 86). The blade (76, 86) is shaped like a plate extending in the radial direction of the piston (75, 85), and projects outwardly from the outer peripheral surface of the piston (75, 85). The blade (76) of the first piston (75) is inserted into a bush hole (78) of the first cylinder (71) and the blade (86) of the second piston (85) is inserted into a bush hole (88) of the second cylinder (81). The bush hole (78, 88) of the cylinder (71, 81) extends through the cylinder (71, 81) in the thickness direction and opens at the inner peripheral surface of the cylinder (71, 81). These bush holes (78, 88) constitute through-holes.

The cylinder (71, 81) is provided with a respective pair of bushes (77, 87). The bush (77, 87) is a small piece which is formed such that it has an inside surface which is a flat surface and an outside surface which is a circular arc surface. In the cylinder (71, 81), the pair of bushes (77, 87) are inserted into the bush hole (78, 88) with the blade (76, 86) sandwiched therebetween. The inside surface of the bush (77, 87) slides against the blade (76, 86) while on the other hand the outside surface the bush (77, 87) slides against the cylinder (71, 81). And, the blade (76, 86) integral with the piston (75, 85) is supported on the cylinder (71, 81) through the bushes (77, 87). The blade (76, 86) is allowed to freely rotate and to go up and down relative to the cylinder (71, 81).

The first fluid chamber (72) within the first cylinder (71) is divided by the first blade (76) integral with the first piston (75), wherein one space defined on the left-hand side of the first blade (76) in FIG. 4 and FIG. 5 becomes a first high-pressure chamber (73) on the high-pressure side and the other space defined on the right-hand side of the first blade (76) in FIG. 4 and FIG. 5 becomes a first low-pressure chamber (74) on the low-pressure side. The second fluid chamber (82) within the second cylinder (81) is divided by the second blade (86) integral with the second piston (85), wherein one space defined on the left-hand side of the second blade (86) in FIG. 4 and FIG. 5 becomes a second high-pressure chamber (83) on the high-pressure side and the other space defined on the right-hand side of the second blade (86) in FIG. 4 and FIG. 5 becomes a second low-pressure chamber (84) on the low-pressure side.

The first and second cylinders (71) and (81) are arranged in such orientation that the position of the buses (77) of the first cylinder (71) and the position of the buses (87) of the second cylinder (81) agree with each other in the circumferential direction. In other words, the disposition angle of the second cylinder (81) with respect to the first cylinder (71) is 0°. As described above, the first and second greater diameter eccentric parts (41) and (42) are off-centered in the same direction relative to the center of axle of the main shaft part (44). Accordingly, at the same time that the first blade (76) reaches its most withdrawn position relative to the direction of the outer periphery of the first cylinder (71), the second blade (86) reaches its most withdrawn position relative to the direction of the outer periphery of the second cylinder (81).

The first cylinder (71) is provided with an inflow port (34). The inflow port (34) opens at an inner peripheral surface portion of the first cylinder (71) located somewhat nearer to the left side of the bush (77) in FIGS. 4 and 5. The inflow port (34) is allowed to be in fluid communication with the first high-pressure chamber (73). On the other hand, the second cylinder (81) is provided with an outflow port (35). The outflow port (35) opens at an inner peripheral surface portion of the second cylinder (38) located somewhat nearer to the right side of the bush (87) in FIGS. 4 and 5. The outflow port (35) is allowed to be in fluid communication with the second low-pressure chamber (84).

The intermediate plate (63) is provided with a communicating passageway (64). The communicating passageway (64) is formed such that it extends through the intermediate plate (63) in the thickness direction. In one surface of the intermediate plate (63) on the side of the first cylinder (71), one end of the communicating passageway (64) opens at a location on the right side of the first blade (76). In the other surface of the intermediate plate (63) on the side of the second cylinder (81), the other end of the communicating passageway (64) opens at a location on the left side of the second blade (86). And, as shown in FIG. 4, the communicating passageway (64) extends obliquely relative to the thickness direction of the intermediate plate (63), thereby allowing the first low-pressure chamber (74) and the second high-pressure chamber (83) to fluidly communicate with each other.

In the shaft (40), passageways branched off from the oil supply passageway (90) are opened, respectively, at the outer peripheral surface of the first greater diameter eccentric part (41), at the outer peripheral surface of the second greater diameter eccentric part (42), and at the outer peripheral surface of the main shaft part (44). Refrigeration oil in the oil supply passageway (90) is supplied, through the branch passageways, to the sliding surfaces of the first greater diameter eccentric part (41) and the first piston (75), to the sliding surfaces of the second greater diameter eccentric part (42) and the second piston (85), and to the sliding surfaces of the main shaft part (44) and the front head (61). As described above, the terminating end of the oil supply passageway (90) is opened at the upper end surface of the shaft (40), and the terminating end of the oil supply passageway (90) is in fluid communication with the end space (95).

The rear head (62) is provided with a lead-out hole (101). The lead-out hole (101) is, at its starting end, in fluid communication with the end space (95). The terminating end of the lead-out hole (101) is opened at the outer peripheral surface of the rear head (62). The terminating end of the lead-out hole (101) is in fluid communication with an oil return pipe (102). The oil return pipe (102) extends downwardly and passes through the front nead (61). The lower end of the oil return pipe (102) is positioned below the discharge pipe (36). The lead-out hole (101) of the rear head (62) and the oil return pipe (102) together constitute an oil return passageway (100). Since the lower end of the oil return pipe (102) serves as the terminating end of the oil return passageway (100), the terminating end of the oil return passageway (100) is positioned below the discharge pipe (36).

In the expansion mechanism (60) of the present embodiment constructed in the way as described above, the first cylinder (71), the buses (77) mounted in the first cylinder (71), the first piston (75), and the first blade (76) together constitute a first rotary mechanism part (70). In addition, the second cylinder (81), the buses (87) mounted in the second cylinder (81), the second piston (85), and the second blade (86) together constitute a second rotary mechanism part (80).

As described above, the first low-pressure chamber (74) of the first rotary mechanism part (70) and the second high-pressure chamber (83) of the second rotary mechanism part (80) are in fluid communication with each other via the communicating passage (64). And, the first low-pressure chamber (74), the communicating passage (64), and the second high-pressure chamber (83) together form a single closed space. The closed space constitutes an expansion chamber (66).

Figure 6:
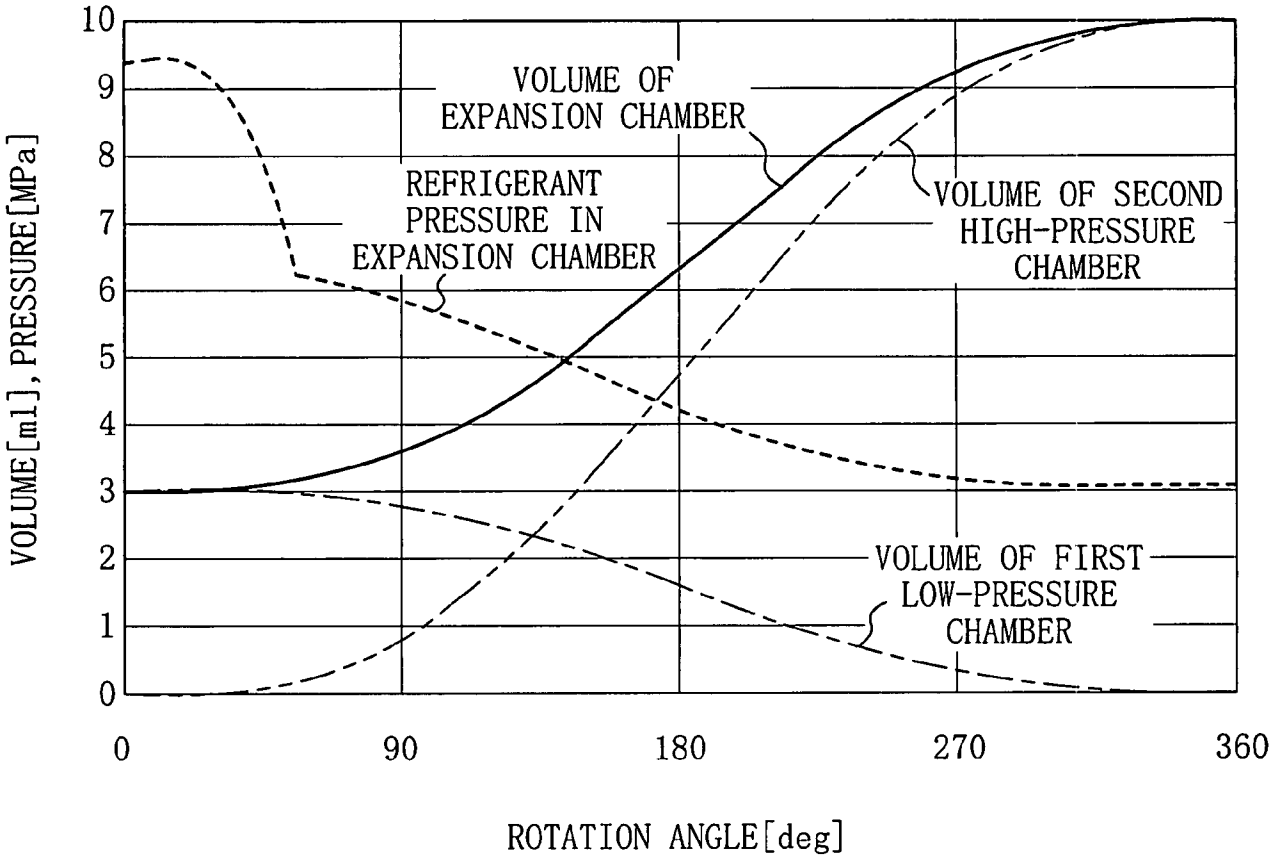
FIG. 6 is a relational diagram which represents relationships of the shaft rotation angle with respect to the volume of each of chambers including an expansion chamber and with respect to the internal pressure of the expansion chamber in the expansion mechanism part of the first embodiment.

The above is described with reference to FIG. 6. In FIG. 6, the rotation angle of the shaft (40) when the first blade (76) reaches its most withdrawn position relative to the direction of the outer periphery of the first cylinder (71) is 0°. In addition, the description will be made, assuming that the maximum volume of the first fluid chamber (72) is 3 ml (milliliter) and the maximum volume of the second fluid chamber (82) is 10 ml.

With reference to FIG. 6, at the point of time when the rotation angle of the shaft (40) is 0°, the volume of the first low-pressure chamber (74) assumes its maximum value of 3 ml and the volume of the second high-pressure chamber (83) assumes its minimum value of 0 ml. The volume of the first low-pressure chamber (74), as indicated by the alternate long and short dash line in the figure, gradually diminishes as the shaft (40) rotates and, at the point of time when the rotation angle of the shaft (40) reaches 360°, assumes its minimum value of 0 ml. On the other hand, the volume of the second high-pressure chamber (83), as indicated by the chain double-dashed line in the figure, gradually increases as the shaft (40) rotates and, at the point of time when the rotation angle of the shaft (40) reaches 360°, assumes its maximum value of 10 ml. And, the volume of the expansion chamber (66) at a certain shaft rotation angle is the sum of the volume of the first low-pressure chamber (74) and the volume of the second high-pressure chamber (83) at that certain shaft rotation angle, when leaving the volume of the communicating passage (64) out of count. In other words, the volume of the expansion chamber (66), as indicated by the solid line in the figure, assumes a minimum value of 3 ml at the point of time when the rotation angle of the shaft (40) is 0°. As the shaft (40) rotates, the volume of the expansion chamber (66) gradually increases and assumes a maximum value of 10 ml at the point of time when the rotation angle of the shaft (40) reaches 360°.

Running Operation

The operation of the foregoing air conditioner (10) is described.

Cooling Operating Mode

In the cooling operating mode, the first four way switching valve (21) and the second four way switching valve (22) each change state to the state indicated by the broken line in FIG. 1. In this state, upon energization of the electric motor (45) of the compression/expansion unit (30), refrigerant circulates in the refrigerant circuit (20) whereby a vapor compression refrigeration cycle is effected.

Refrigerant compressed in the compression mechanism (50) passes through the discharge pipe (36) and is then discharged out of the compression/expansion unit (30). In this state, the refrigerant is at a pressure above its critical pressure. This discharged refrigerant is fed, by way of the first four way switching valve (21), to the outdoor heat exchanger (23). In the outdoor heat exchanger (23), the inflow refrigerant dissipates heat to outside air.

Refrigerant after heat dissipation in the outdoor heat exchanger (23) passes through the second four way switching valve (22) and then through the inflow port (34) and flows into the expansion mechanism (60) of the compression/expansion unit (30). In the expansion mechanism (60), high-pressure refrigerant expands and its internal energy is converted into power which is used to rotate the shaft (40). Low-pressure refrigerant after expansion flows out of the compression/expansion unit (30) through the outflow port (35), passes through the second four way switching valve (22), and is delivered to the indoor heat exchanger (24).

In the indoor heat exchanger (24), the inflow refrigerant absorbs heat from room air and evaporates and, as a result, the room air is cooled. Low-pressure gas refrigerant exiting the indoor heat exchanger (24) passes through the first four way switching valve (21) and then through the suction port (32) and is drawn into the compression mechanism (50) of the compression/expansion unit (30). The compression mechanism (50) compresses and discharges the drawn refrigerant.

Heating Operating Mode

In the heating operating mode, the first four way switching valve (21) and the second four way switching valve (22) each change state to the state indicated by the solid line in FIG. 1. In this state, upon energization of the electric motor (45) of the compression/expansion unit (30), refrigerant circulates in the refrigerant circuit (20) whereby a vapor compression refrigeration cycle is effected.

Refrigerant compressed in the compression mechanism (50) passes through the discharge pipe (36) and is then discharged out of the compression/expansion unit (30). In this state, the refrigerant is at a pressure above its critical pressure. This discharged refrigerant passes through the first four way switching valve (21) and is then delivered to the indoor heat exchanger (24). In the indoor heat exchanger (24), the inflow refrigerant dissipates heat to room air and, as a result, the room air is heated.

Refrigerant after heat dissipation in the indoor heat exchanger (24) passes through the second four way switching valve (22) and then through the inflow port (34) and flows into the expansion mechanism (60) of the compression/expansion unit (30). In the expansion mechanism (60), high-pressure refrigerant expands and its internal energy is converted into power which is used to rotate the shaft (40). Low-pressure refrigerant after expansion flows out of the compression/expansion unit (30) by way of the outflow port (35), passes through the second four way switching valve (22), and is fed to the outdoor heat exchanger (23).

In the outdoor heat exchanger (23), the inflow refrigerant absorbs heat from outside air and evaporates. Low-pressure gas refrigerant exiting the outdoor heat exchanger (23) passes through the first four way switching valve (21) and then through the suction port (32) and is drawn into the compression mechanism (50) of the compression/expansion unit (30). The compression mechanism (50) compresses and discharges the drawn refrigerant.

Operation of the Expansion Mechanism

By making reference to FIG. 5, the operation of the expansion mechanism (60) is described below.

In the first place, the process, in which high-pressure refrigerant in the supercritical state flows into the first high-pressure chamber (73) of the first rotary mechanism part (70), is described. When the shaft (40) makes a slight rotation from the rotation angle 0° state, the position of contact between the first piston (75) and the first cylinder (71) passes through the opening part of the inflow port (34), thereby allowing high-pressure refrigerant to start flowing into the first high-pressure chamber (73) from the inflow port (34). Thereafter, as the rotation angle of the shaft (40) gradually increases to 90°, then to 180°, and then to 270°, high-pressure refrigerant keeps flowing into the first high-pressure chamber (73). The inflowing of high-pressure refrigerant into the first high-pressure chamber (73) continues until the rotation angle of the shaft (40) reaches 360°.

Next, the process in which refrigerant expands in the expansion mechanism (60) is described. When the shaft (40) makes a slight rotation from the rotation angle 0° state, the first low-pressure chamber (74) and the second high-pressure chamber (83) become fluidly communicative with each other via the communicating passageway (64) and, as a result, refrigerant starts flowing into the second high-pressure chamber (83) from the first low-pressure chamber (74). Thereafter, as the rotation angle of the shaft (40) gradually increases to 90°, then to 180°, and then to 270°, the volume of the first low-pressure chamber (74) gradually decreases while simultaneously the volume of the second high-pressure chamber (83) gradually increases. Consequently, the volume of the expansion chamber (66) gradually increases. The volume of the expansion chamber (66) continues to increase just before the rotation angle of the shaft (40) reaches 360°. And, in the process during which the volume of the expansion chamber (66) increases, the refrigerant in the expansion chamber (66) expands. By virtue of such refrigerant expansion, the shaft (40) is rotationally driven. In this way, the refrigerant within the first low-pressure chamber (74) flows by way of the communication passage (64) into the second high-pressure chamber (83) while expanding.

In the refrigerant expansion process, the refrigerant pressure within the expansion chamber (66) gradually falls as the rotation angle of the shaft (40) becomes increased, as indicated by the broken line in FIG. 6. More specifically, refrigerant in the supercritical state with which the first low-pressure chamber (74) is filled up undergoes an abrupt pressure drop by the time the rotation angle of the shaft (40) reaches about 55°, and enters the saturated liquid state. Thereafter, the refrigerant within the expansion chamber (66) gradually decreases in pressure while partially evaporating.

Subsequently, the process, in which refrigerant flows out of the second low-pressure chamber (84) of the second rotary mechanism part (80), is described. The second low-pressure chamber (84) starts fluidly communicating with the outflow port (35) from the point of time when the rotation angle of the shaft (40) is 0°. Stated another way, refrigerant starts flowing out to the outflow port (35) from the second low-pressure chamber (84). Thereafter, the rotation angle of the shaft (40) gradually increases to 90°, then to 180°, and then to 270°. Over a period of time until the rotation angle of the shaft (40) reaches 360°, low-pressure refrigerant after expansion flows out of the second low-pressure chamber (84).

Oil Supply Operation in the Compression/Expansion Unit

The operation of supplying refrigeration oil to the compression mechanism (50) and to the expansion mechanism (60) in the compression/expansion unit (30) is described.

Refrigeration oil is accumulated in the bottom of the casing (31), i.e., in the bottom part of the second space (39). The temperature of the accumulated refrigeration oil is at the same level of the temperature of refrigerant discharged to the second space (39) from the compressor mechanism (50), i.e., about 90 degrees Centigrade.

As the shaft (40) rotates, refrigeration oil accumulated in the bottom of the casing (31) is drawn into the oil supply passageway (90). A part of the refrigeration oil flowing upwards in the oil supply passageway (90) is supplied to the compression mechanism (50). The refrigeration oil supplied to the compression mechanism (50) is used to provide sliding surface lubrication between the lower eccentric part (58, 59) and the piston (57, 57), sliding surface lubrication between the front head (54) and the main shaft part (44), or sliding surface lubrication between the rear head (55) and the main shaft part (44).

The remaining refrigeration oil that has not been supplied to the compression mechanism (50) flows upwardly in the oil supply passageway (90). A part of the remaining refrigeration oil is supplied to the expansion mechanism (60). The refrigeration oil supplied to the expansion mechanism (60) is used to provide sliding surface lubrication between the greater diameter eccentric part (41, 42) and the piston (75, 85) and sliding surface lubrication between the main shaft part (44) and of the front head (61).

Surplus refrigeration oil supplied to neither of the compression and expansion mechanisms (50) and (60) is expelled to the end space (95) from the terminating end of the oil supply passageway (90). Almost all of the surplus refrigeration oil expelled to the end space (95) flows into the lead-out hole (101). The surplus refrigeration oil which has flowed into the lead-out hole (101) is returned back towards the second space (39) by way of the oil return pipe (102). The surplus refrigeration oil flowing out of the lower end of the oil return pipe (102) falls down by gravity and is brought back to the bottom part of the second space (39). In this way, the surplus refrigeration oil flowing out of the terminating end of the oil supply passageway (90) is passed through the oil return pipe (102) and is sent back towards the compression mechanism (50) from the side of the expansion mechanism (60).

In the way as described above, the surplus refrigeration oil expelled out of the terminating end of the oil supply passageway (90) is collected in the end space (95) and is sent back to the second space's (39) side by the oil return passageway (100) formed by the lead-out hole (101) and the oil return pipe (102). Stated another way, the surplus refrigeration oil is introduced directly into the oil return passageway (100) from the terminating end of the oil supply passageway (90) and is delivered towards the second space (39).

In addition, as described above, the lower end of the oil return pipe (102) is positioned below the discharge pipe (36). As a result of such arrangement, very little refrigeration oil moves upwards and flows into the discharge pipe (36) after leaving the oil return pipe (102) and, even if there exists such refrigeration oil, the amount thereof is negligible. Accordingly, surplus refrigeration oil flowing out of the lower end of the oil return pipe (102) does not enter the discharge pipe (36) together with discharge refrigerant, and almost all of the surplus refrigeration oil is returned back to the bottom part of the second space (39).

Effects of the First Embodiment

Here, high-pressure refrigerant having, for example, a temperature of about 30 degrees Centigrade flows into the expansion mechanism (60). The high-pressure refrigerant expands and becomes a low-pressure refrigerant having, for example, about 0 degrees Centigrade. Then, the low-pressure refrigerant leaves the expansion mechanism (60). On the other hand, the temperature of surplus refrigeration oil discharged from the terminating end of the oil supply passageway (90) is higher than the temperature of refrigerant passing through the expansion mechanism (60). Consequently, when employing a structure in which surplus refrigeration oil overflowing from the terminating end of the oil supply passageway (90) runs down along the surface of the expansion mechanism (60), the length of time for which the surplus refrigeration oil is in contact with the expansion mechanism (60) the temperature of which is relatively low becomes longer, thereby increasing the amount of heat input to the refrigerant passing through the expansion mechanism (60) from the surplus refrigeration oil. The enthalpy of refrigerant, delivered to the indoor heat exchanger (24) which becomes an evaporator in the cooling operating mode from the expansion mechanism (60), increases, thereby resulting in causing a drop in cooling capacity.

On the other hand, in the compression/expansion unit (30) of the present embodiment, it is arranged such that surplus refrigeration oil which has not been used for lubrication of the compression and expansion mechanisms (50) and (60) is introduced into the oil return passageway (100) from the terminating end of the oil supply passageway (90) and is immediately returned back towards the second space (39). Accordingly, in comparison with the above-described structure in which surplus lubricating oil flows along the surface of the expansion mechanism (60), the length of time for which surplus lubricating oil is in contact with the expansion mechanism (60) can be reduced, thereby making it possible to cut down the amount of heat transfer to the refrigerant in the expansion mechanism (60) from the surplus lubricating oil. The enthalpy of refrigerant, delivered to the indoor heat exchanger (24) which becomes an evaporator in the cooling operating mode from the expansion mechanism (60), is inhibited from increasing, thereby making it possible to provide sufficient cooling capacity.

In addition, in the compression/expansion unit (30) of the present embodiment, in order to prevent refrigeration oil leaving the oil return pipe (102) from flowing into the discharge pipe (36), it is arranged such that the lower end of the oil return pipe (102) is positioned below the starting end of the discharge pipe (36). As a result of such arrangement, it becomes possible to reduce the amount of refrigeration oil flowing out of the discharge pipe (36) along with the refrigerant discharged from the compression mechanism (50), whereby the storage amount of refrigeration oil in the casing (31) is secured. As a result, the amount of refrigeration oil supply to the compression mechanism (50) and the amount of refrigeration oil supply to the expansion mechanism (60) can be secured, thereby forestalling the occurrence of troubles such as seizing et cetera.

In addition, if refrigeration oil flowing out of the compression/expansion unit (30) is trapped in the outdoor heat exchanger (23) and in the indoor heat exchanger (24), refrigerant-air heat exchange in the heat exchangers (23, 24) is prevented by the trapped refrigeration oil. Therefore, if the amount of refrigeration oil flowing out of the compression/expansion unit (30) along with refrigerant is reduced as in the present embodiment, this makes it possible to avoid performance deterioration of the heat exchangers (23, 24) due to the trapping of refrigeration oil.

Second Embodiment of the Invention

A second embodiment of the present invention is described. The present embodiment results from modification of the structure of the compression/expansion unit (30) of the first embodiment. Here, in regard to the compression/expansion unit (30) of the present embodiment, the difference from the compression/expansion unit (30) of the first embodiment is described.

Figure 7:
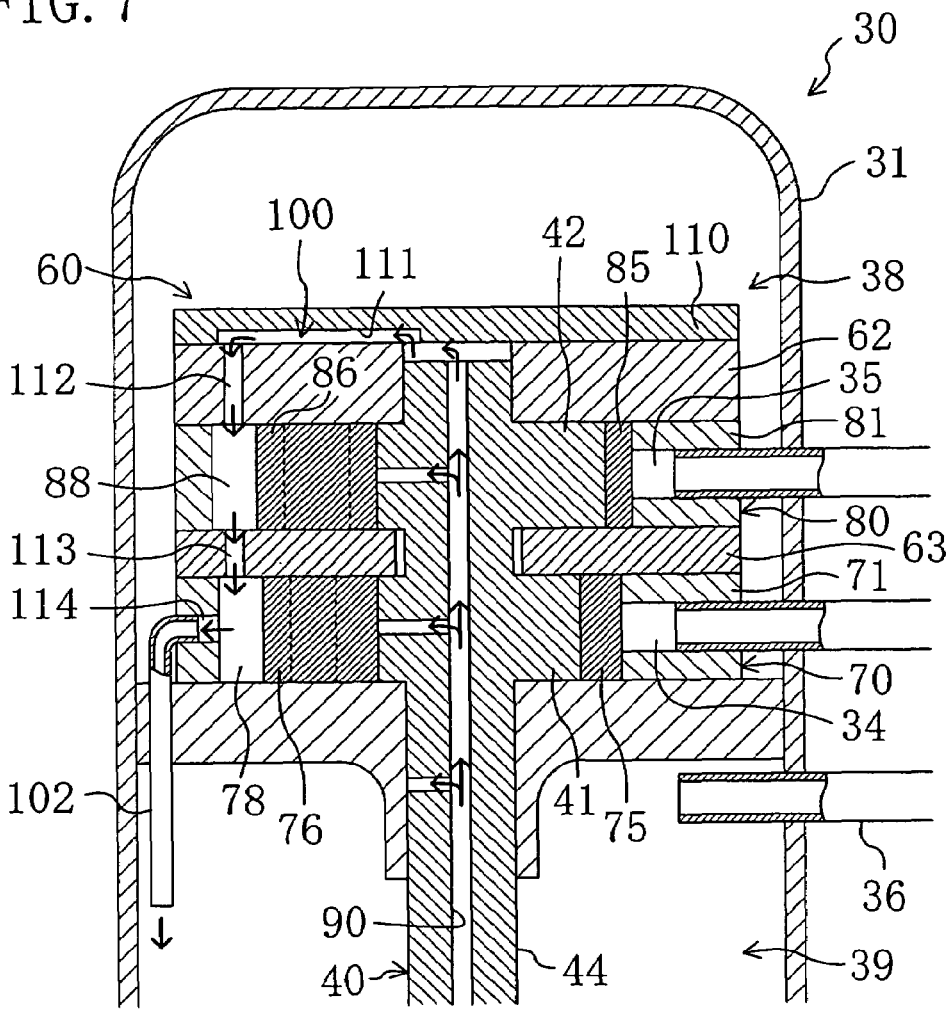
FIG. 7 is an enlarged cross section view which illustrates a main section of an expansion mechanism part of a second embodiment of the present invention.

As shown in FIG. 7, in the expansion mechanism (60) of the present embodiment, a central hole is centrally formed in the rear head (62) such that it extends through the rear head (62) in the thickness direction. The shaft (40) is, at its upper end part, inserted into the central hole of the rear head (62).

The expansion mechanism (60) is provided with an upper plate (110). The upper plate (110) is placed on the rear head (62) and forms, together with the central hole of the rear head (62) and the upper end surface of the shaft (40), an end space (95). A lead-out groove (111) is formed in the upper plate (110). The lead-out groove (111) is formed by drilling down a lower surface portion of the upper plate (110). In addition, the lead-out groove (111) overlaps, at its starting end, the end space (95) and extends towards the outer periphery of the upper plate (110).

In the expansion mechanism (60), a first communicating hole (112) is formed in the rear head (62) and a second communicating hole (113) is formed in the intermediate plate (63). The first communicating hole (112) passes completely through the rear head (62) in the thickness direction, thereby bringing the terminating end of the lead-out groove (111) into fluid communication with the bush hole (88) of the second cylinder (81). The second communicating hole (113) passes completely through the intermediate plate (63) in the thickness direction, thereby bringing the bush hole (88) of the second cylinder (81) into fluid communication with the bush hole (78) of the first cylinder (71).

In addition, in the expansion mechanism (60), a lead-out hole (114) is formed in the first cylinder (71). More specifically, the lead-out hole (114) is formed in a heightwise central portion of the first cylinder (71), and the starting end of the lead-out groove (114) opens to the bush hole (78). An oil return pipe (102) is fluidly connected to the terminating end of the lead-out hole (114) which opens at the outer peripheral surface of the first cylinder (71). This oil return pipe (102), like its counterpart in the first embodiment, passes completely through the front head (61) and extends to the second space (39), and its terminating end is positioned below the discharge pipe (36).

In the compression/expansion unit (30) of the present embodiment, the lead-out groove (111) of the upper plate (110), the first communicating hole (112) of the rear head (62), the bush hole (88) of the second cylinder (81), the second communicating hole (113) of the intermediate plate (63), the bush and lead-out holes (78, 114) of the first cylinder (71), and the oil return pipe (102) together form an oil return passage (100). In other words, in the compression/expansion unit (30), the bush hole (78, 88) of the cylinder (71, 88) constitutes a part of the oil return passageway (100).

In the compression/expansion unit (30), surplus refrigeration oil discharged to the end space (95) from the terminating end of the oil supply passageway (90) flows, through the lead-out groove (111) and then through the first communicating hole (112), into the bush hole (88) of the second cylinder (81). The refrigeration oil which has flowed into the bush hole (88) is used to provide sliding surface lubrication between the second cylinder (81) and the bush (87) and sliding surface lubrication between the bush (87) and the second blade (86). Subsequently, the refrigeration oil flows, through the bush hole (88) of the second cylinder (81) and then through the second communicating hole (113), into the bush hole (78) of the first cylinder (71). The refrigeration oil which has flowed into the bush hole (78) is used to provide sliding surface lubrication between the first cylinder (71) and the bushes (77) and sliding surface lubrication between the bushes (77) and the first blade (76). Thereafter, the refrigeration oil flows, through the lead-out hole (114), into the oil return pipe (102) and is returned back towards the second space (39). In this way, surplus refrigeration oil flowing out of the terminating end of the oil supply passageway (90) is fed back towards the compression mechanism (50) from the expansion mechanism's (60) side by way of the bush hole (88), the oil return pipe (102) et cetera.

Effects of the Second Embodiment

In accordance with the present embodiment, the following advantageous effects are obtained in addition to the advantageous effects provided in the first embodiments. In other words, in accordance with the present embodiment, it becomes possible to make utilization of surplus refrigeration oil discharged out of the oil supply passageway (90) to thereby provide lubrication to the bushes (77, 87) and the blades (76, 86). Accordingly, it is possible to supply sufficient amounts of refrigeration oil to the bushes (77, 87) and the blades (76, 86) which conventionally tend to be short of refrigeration oil supply in a commonly-used swinging piston type rotary expander, thereby making it possible to improve the reliability of the expansion mechanism (60).

In addition, in the present embodiment, it is arranged such that the lead-out hole (114) is formed in the heightwise central portion of the first cylinder (71). This therefore causes refrigeration oil to be accumulated in a portion of the bush hole (78) positioned below the lead-out hole (114). Consequently, even in the operating state in which the amount of oil supply tends to become short (for example, immediately after activation), it is ensured that the bushes (77) and the first blade (76) are surely lubricated with refrigeration oil trapped in the bush hole (78) of the first cylinder (71).

Third Embodiment of the Invention

A third embodiment of the present invention is described. The present embodiment results from modification of the structure of the compression/expansion unit (30) of the first embodiment. Here, in regard to the compression/expansion unit (30) of the present embodiment, the difference from the compression/expansion unit (30) of the first embodiment is described.

Figure 8:
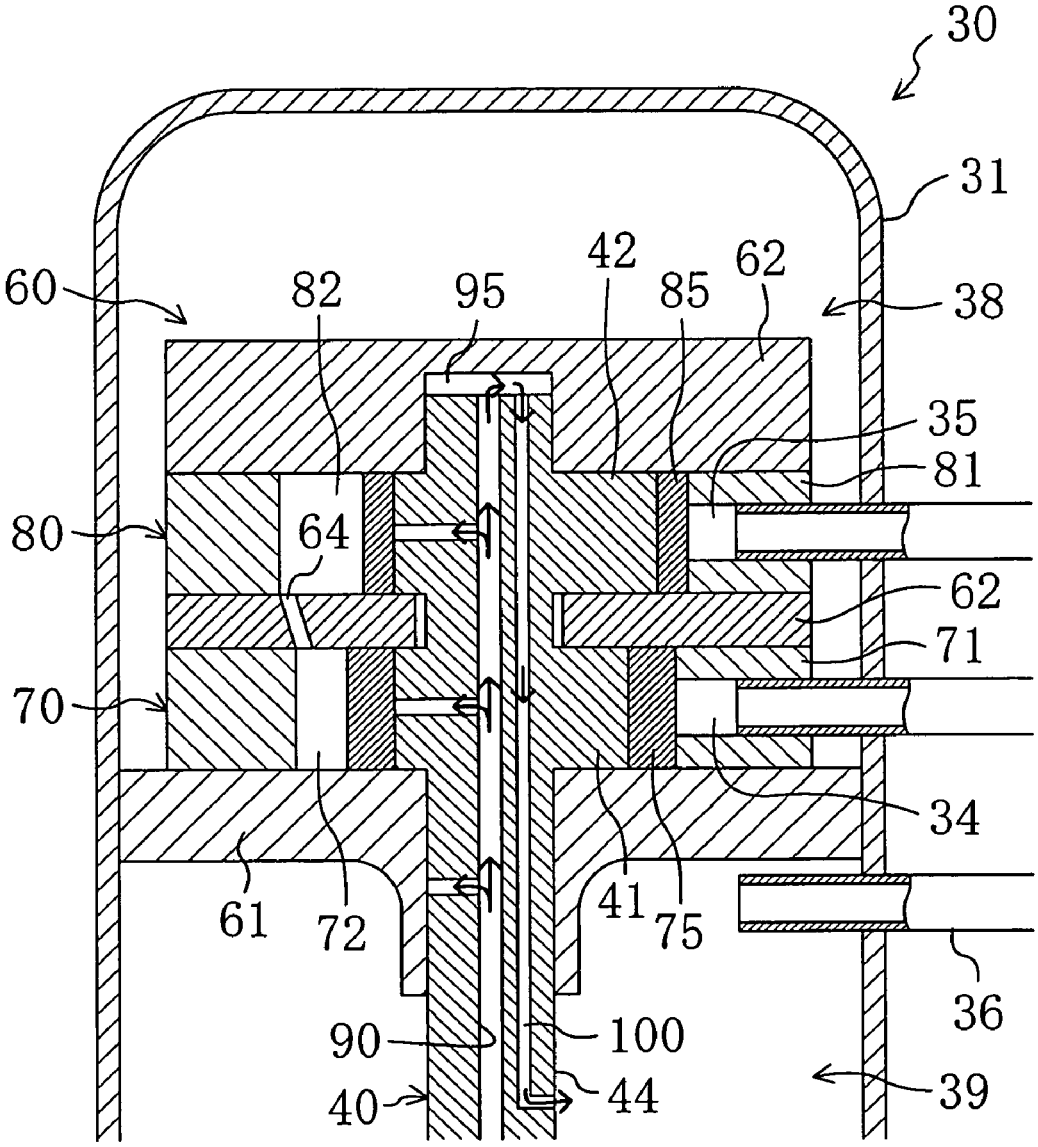
FIG. 8 is an enlarged cross section view which illustrates a main section of an expansion mechanism part of a third embodiment of the present invention.

As shown in FIG. 8, in the compression/expansion unit (30) of the present embodiment, the oil return passageway (100) is formed in the shaft (40), and the lead-out hole (101) and the oil return pipe (102) are omitted in the rear head (62). In the shaft (40), the oil return passageway (100) is formed along the oil supply passageway (90).

The oil return passageway (100) opens, at its terminating end, at the upper end surface of the shaft (40) and is in fluid communication with the end space (95). The terminating end of the oil return passageway (100) opens at the outer peripheral surface of the main shaft part (44) of the shaft (40) and is in fluid communication with the second space (39). In addition, the opening position of the terminating end of the oil return passageway (100) at the outer peripheral surface of the main shaft part is situated below the starting end of the discharge pipe (36). As just described, the terminating end of the oil return passageway (100) opens on the side of the compression mechanism (50) in the casing (31). And, surplus refrigeration oil flowing out of the terminating end of the oil supply passageway (90) is sent back to the compression mechanism's (50) side from the expansion mechanism's (60) side from the oil return passageway (100).

In the compression/expansion unit (30), surplus refrigeration oil discharged to the end space (95) from the terminating end of the oil supply passageway (90) flows into the oil return passageway (100) formed in the shaft (40).

Here, the temperature of refrigeration oil drawn into the oil supply passageway (90) from the bottom part of the second space (39) (for example, about 90 degrees Centigrade) is higher than the temperature of the expansion mechanism (60) through which refrigerant (about 0 degrees Centigrade to about 30 degrees Centigrade) flows. Therefore, the refrigeration oil flowing through the oil supply passageway (90) will have decreased in temperature to some extent until it reaches the terminating end of the oil supply passageway (90). In other words, the surplus refrigeration oil flowing into the oil return passageway (100) from the terminating end of the oil supply passageway (90) is lower in temperature than the refrigerant flowing through the oil supply passageway (90).

On the other hand, since the main shaft part (44) of the shaft (40) is not so thick, the oil supply passageway (90) and the oil return passageway (100) are in close proximity with each other. Accordingly, in the shaft (40), heat exchange takes place between refrigeration oil flowing upwards through the oil supply passageway (90) and refrigeration oil flowing downwards through the oil return passageway (100). As a result, the refrigeration oil which is supplied, through the oil supply passageway (90), to the expansion mechanism (60) is cooled by the refrigeration oil in the oil return passageway (100). In other words, the shaft (40) in which both the oil supply passageway (90) and the oil return passageway (100) are formed constitutes a heat exchange means which causes the refrigeration oil in the oil supply passageway (90) to exchange heat with the refrigeration oil in the oil return passageway (100).

In the way as described above, in accordance with the present embodiment, it becomes possible to reduce the temperature of refrigeration oil which is supplied to the expansion mechanism (60) from the oil supply passageway (90), thereby making it possible to reduce the amount of heat transfer from the refrigeration oil to the refrigerant passing through the expansion mechanism (60) to a further extent. As a result, it becomes possible to further reduce the increase in enthalpy of the refrigerant which is fed to the indoor heat exchanger (24) which becomes an evaporator during the cooling operating mode from the expansion mechanism (60), and the cooling capacity of the air conditioner (10) is improved.

In addition, in accordance with the present embodiment, the oil return passageway (100) can be formed only by performing machining on the shaft (40), and the increase in the number of manufacture steps and the increase in the cost of manufacture due to the provision of the oil return passageway (100) are prevented.

Fourth Embodiment of the Invention

A fourth embodiment of the present invention is described. The present embodiment results from modification of the structure of the compression/expansion unit (30) of the first embodiment. Here, in regard to the compression/expansion unit (30) of the present embodiment, the difference from the compression/expansion unit (30) of the first embodiment is described.

Figure 9:
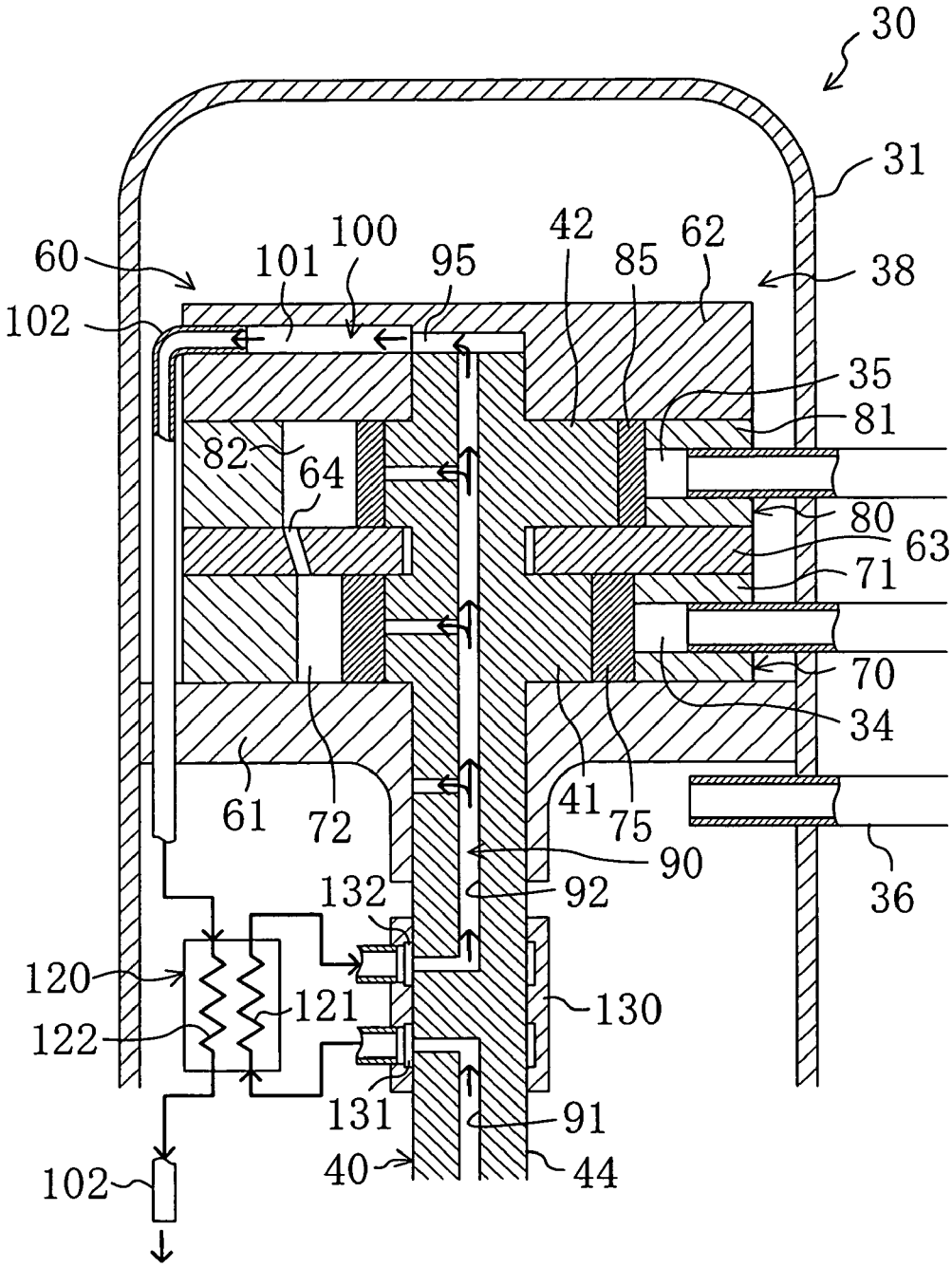
FIG. 9 is an enlarged cross section view which illustrates a main section of an expansion mechanism part of a fourth embodiment of the present invention.

As shown in FIG. 9, the compression/expansion unit (30) of the present embodiment is provided with a relay member (130) and a heat exchanger (120). In addition, the oil supply passageway (90) formed in the shaft (40) of the present embodiment is formed by a first oil passageway (91) and a second oil passageway (92).

The relay member (130) is shaped like a cylinder. The main shaft part (44) of the shaft (40) is inserted into the relay member (130). In addition, two inner peripheral grooves (131, 132) are formed all around the inner peripheral surface of the relay member (130). Of these two inner peripheral grooves (131, 132), the underlying one constitutes a first inner peripheral groove (131) and the overlying one constitutes a second inner peripheral groove (132).

The oil supply passageway (90) is divided halfway relative to the elevation direction into two sections. The underlying section constitutes a first oil passageway (91) and the overlying section constitutes a second oil passageway (92). The terminating end of the first oil passageway (91) opens at the outer peripheral surface of the main shaft part (44) and is in fluid communication with the first inner peripheral groove (131) of the relay member (130). On the other hand, the starting end of the second oil passageway (92) opens at the outer peripheral surface of the main shaft part (44) and is in fluid communication with the second inner peripheral groove (132) of the relay member (130).

The heat exchanger (120) is provided with a first flowpath (121) and a second flowpath (122). The starting end of the first flowpath (121) is fluidly connected to the first inner peripheral groove (131) of the relay member (130) and the terminating end of the first flowpath (121) is fluidly connected to the second inner peripheral groove (132) of the relay member (130). On the other hand, the second flowpath (122) is connected midway along the oil return pipe (102). The heat exchanger (120) constitutes a heat exchange means capable of effecting heat exchange between refrigeration oil flowing into the first flowpath (121) from the oil supply passageway (90) and refrigeration oil flowing into the second flowpath (122) from the oil return pipe (102).

As explained in the description about the third embodiment, the temperature of surplus refrigeration oil flowing into the oil return passageway (100) from the terminating end of the oil supply passageway (90) is lower than the temperature of refrigeration oil flowing through the oil supply passageway (90). Consequently, in the heat exchanger (120), refrigeration oil introduced into the first flowpath (121) from the first oil passageway (91) is cooled by surplus refrigeration oil introduced into the second flowpath (122) from the oil return pipe (102). And the refrigeration oil cooled during flow through the first flowpath (121) of the heat exchanger (120) is supplied to the expansion mechanism (60) by way of the second oil passageway (92).

As described above, in accordance with the present embodiment, the temperature of refrigeration oil which is supplied to the expansion mechanism (60) from the oil supply passageway (90) can be reduced, thereby making it possible to reduce the amount of heat transfer from the refrigeration oil to the refrigerant passing through the expansion mechanism (60) to a further extent. As a result, it becomes possible to further reduce the increase in enthalpy of the refrigerant which is fed to the indoor heat exchanger (24) from the expansion mechanism (60), thereby making it possible to improve the cooling capacity of the air conditioner (10).

Fifth Embodiment of the Invention

A fifth embodiment of the present invention is described. The present embodiment results from modification of the structure of the compression/expansion unit (30) of the first embodiment. Here, in regard to the compression/expansion unit (30) of the present embodiment, the difference from the compression/expansion unit (30) of the first embodiment is described.

Figure 10:
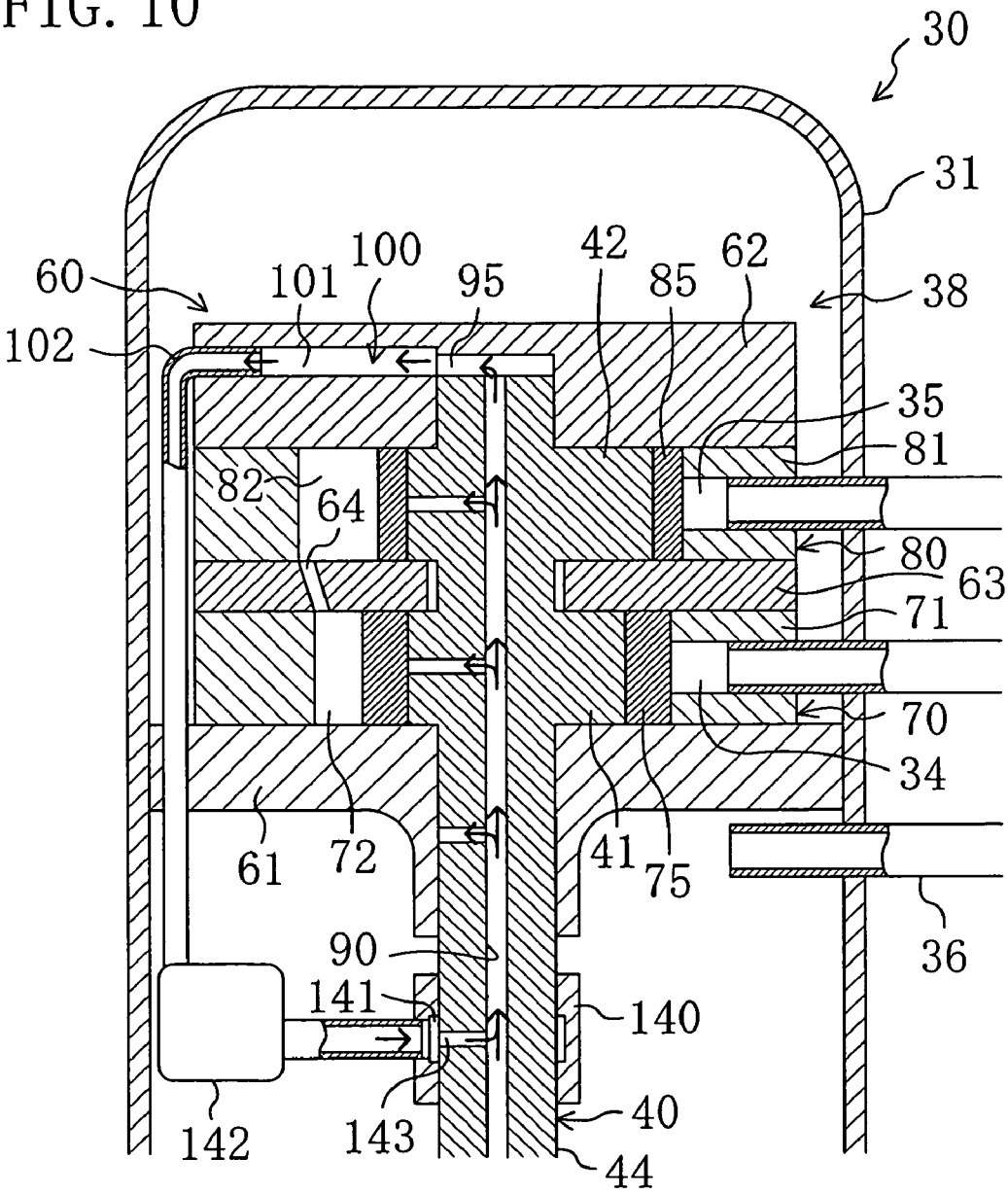
FIG. 10 is an enlarged cross section view which illustrates a main section of an expansion mechanism part of a fifth embodiment of the present invention.

As shown in FIG. 10, the compression/expansion unit (30) of the present embodiment is provided with a connecting member (140) and a buffer tank (142). In addition, a merging passageway (143) is formed in the shaft (40) of the present embodiment.

The connecting member (140) is shaped like a cylinder. The main shaft part (44) of the shaft (40) is inserted through the connecting member (140). In addition, a single inner peripheral groove (141) is formed all around the inner peripheral surface of the connecting member (140). The starting end of the merging passageway (143) opens at the outer peripheral surface of the main shaft part (44) and is in fluid communication with the inner peripheral groove (141) of the connecting member (140). The merging passageway (143) extends horizontally from the starting end and is fluidly connected, at the terminating end, to the oil supply passageway (90).

The buffer tank (142) is disposed midway along the oil return pipe (102). The buffer tank (142) is provided to temporarily store surplus refrigeration oil flowing through the oil return pipe (102). In addition, the terminating end of the oil return pipe (102) in the present embodiment is fluidly connected to the inner peripheral groove (141) of the connecting member (140) and is not in fluid communication with the second space (39).

In the compression/expansion unit (30), surplus refrigeration oil expelled out of the terminating end of the oil supply passageway (90) once flows into the buffer tank (142) by way of the oil return pipe (102) and is delivered back to the oil supply passageway (90) from the inner peripheral groove (141) of the connecting member (140) by way of the merging passageway (143). In other words, surplus refrigeration oil flowing out of the terminating end of the oil supply passageway (90) is fed back to the compression mechanism's (50) side from the expansion mechanism's (60) side by way of the oil return pipe (102). And the expansion mechanism (60) is supplied with a mixture of refrigeration oil drawn up from the bottom part of the second space (39) and surplus refrigeration oil delivered from the oil return pipe (102) by way of the merging passageway (143).

As explained in the description about the third embodiment, the temperature of surplus refrigeration oil flowing into the oil return passageway (100) from the terminating end of the oil supply passageway (90) is lower than the temperature of refrigeration oil drawn up to the oil supply passageway (90) from the bottom part of the second space (39). Consequently, if refrigeration oil drawn up from the bottom part of the second space (39) is mixed with surplus refrigeration oil from the oil return pipe (102) and the mixture is supplied to the expansion mechanism (60), this makes it possible to lower the temperature of refrigeration oil which is supplied to the expansion mechanism (60) from the oil supply passageway (90), and the amount of heat transfer to the refrigerant passing through the expansion mechanism (60) from the refrigeration oil can be reduced to a further extent. As a result, it becomes possible to further reduce the increase in enthalpy of the refrigerant which is delivered to the indoor heat exchanger (24) which becomes an evaporator during the cooling operating mode from the expansion mechanism (60), thereby enhancing the cooling capacity of the air conditioner (10).

Other Embodiments

Figure 11:
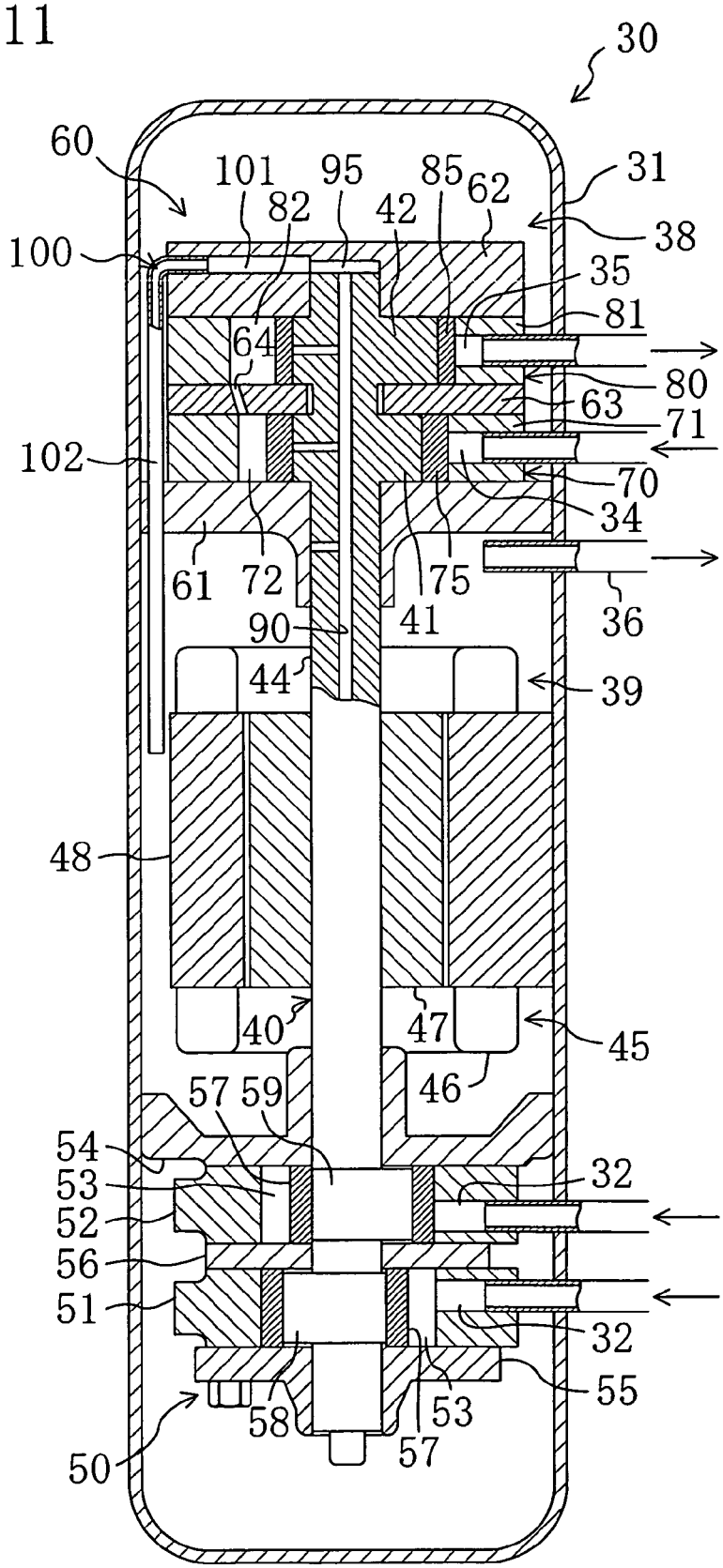
FIG. 11 is a schematic cross section view of a compression/expansion unit of another embodiment of the present invention.

In the compression/expansion unit (30) of each of the first and second embodiments, it may be arranged such that the oil return pipe (102) is extended further downwards so that the lower end of the oil return pipe (102) is situated in a clearance defined between the core cut part (48) of the stator (46) and the casing (31), as shown in FIG. 11. In this case, the lower end of the oil return pipe (102), i.e., the terminating end of the oil return passageway (100), departs from the discharge pipe (36), thereby making it possible to further reduce the amount of refrigeration oil flowing into the discharge pipe (36). FIG. 11 shows an example in which this modification is applied to the first embodiment.

In addition, in each of the foregoing embodiments, the expansion mechanism (60) may be formed by a rotary expander of the rolling piston type. In the expansion mechanism (60) of this modification example, the blade (76, 86) is formed as a separate body from the piston (75, 85) in the rotary mechanism part (70, 80). And, the tip of the blade (76, 86) is pressed against the outer peripheral surface of the piston (75, 85) and advances and retreats as the piston (75, 85) moves.

It should be noted that the above-descried embodiments are essentially preferable examples which are not intended to limit the present invention, its application, or its application range.

INDUSTRIAL APPLICABILITY

As has been described above, the present invention is useful for expanders which produce power by the expansion of high-pressure fluid.

What is claimed is:

1. A fluid machine in which:

an expansion mechanism for producing power by the expansion of fluid, a compression mechanism for compressing fluid, and a rotating shaft for transmitting power produced in the expansion mechanism to the compression mechanism are housed in a container-shaped casing; and fluid discharged from the compression mechanism is fed to the outside of the casing by way of an internal space defined in the casing;

wherein:

lubricating oil is stored on the side of the compression mechanism in the inside of the casing; and the fluid machine comprises:

an oil supply passageway which is formed in the rotating shaft and which supplies lubricating oil stored in the inside of the casing to a sliding portion of the expansion mechanism and has a terminating end from which surplus lubricating oil which has not been supplied to the sliding portion of the expansion mechanism is discharged; and an oil return passageway for guiding the surplus lubricating oil towards the compression mechanism from the terminating end of the oil supply passageway.

2. A fluid machine in which:

an expansion mechanism for producing power by the expansion of fluid, a compression mechanism for compressing fluid, and a rotating shaft for transmitting power produced in the expansion mechanism to the compression mechanism are housed in a container-shaped casing;

the inside of the casing is divided into a first space in which the expansion mechanism is disposed and a second space in which the compression mechanism is disposed; and fluid discharged from the compression mechanism is fed to the outside of the casing by way of the second space;

wherein:

the fluid machine comprises:

an oil supply passageway which is formed in the rotating shaft and which supplies lubricating oil stored in the second space to a sliding portion of the expansion mechanism and has a terminating end from which surplus lubricating oil which has not been supplied to the sliding portion of the expansion mechanism is discharged; and an oil return passageway for guiding the surplus lubricating oil towards the second space from the terminating end of the oil supply passageway.

3. The fluid machine of either claim 1 or claim 2, wherein heat exchange means for effecting heat transfer between lubricating oil in the oil supply passageway and lubricating oil in the oil return passageway is provided.

4. The fluid machine of either claim 1 or claim 2, wherein along the oil supply passageway the oil return passageway is formed in the rotating shaft.

5. The fluid machine of either claim 1 or claim 2, wherein the oil return passageway is fluidly connected at its terminating end to the oil supply passageway.

6. The fluid machine of either claim 1 or claim 2, wherein:

the expansion mechanism is formed by a rotary expander which comprises a cylinder whose both ends are blocked, a piston for forming a fluid chamber within the cylinder, and a blade for dividing the fluid chamber into a high-pressure side and a low-pressure side;

the cylinder is provided with a through-hole which extends completely through the cylinder in a thickness direction thereof and into which the blade is inserted; and the through-hole of the cylinder constitutes a part of the oil return passageway.

7. The fluid machine of either claim 1 or claim 2, wherein:

the casing is provided with a discharge pipe through which fluid discharged from the compression mechanism is led out to the outside of the casing; and the oil return passageway has a terminating end which is so positioned as to inhibit lubricating oil leaving the terminating end from flowing into the discharge pipe.

8. The fluid machine of either claim 1 or claim 2, wherein:

in the inside of the casing the expansion mechanism is arranged above the compression mechanism;

a discharge pipe, through which fluid discharged from the compression mechanism is led out to the outside of the casing, is arranged between the compression mechanism and the expansion mechanism in the casing; and the oil return passageway has a terminating end which is positioned below a starting end of the discharge pipe.

9. The fluid machine of either claim 1 or claim 2, wherein:

an electric motor, coupled to the rotating shaft to drive the compression mechanism, is arranged between the compression mechanism and the expansion mechanism in the casing;

a discharge pipe, through which fluid discharged from the compression mechanism is led out to the outside of the casing, is arranged between the electric motor and the expansion mechanism in the casing; and the oil return passageway has a terminating end which is positioned in a clearance defined between a core cut part formed in the outer periphery of a stator of the electric motor and the casing.

10. The fluid machine of claim 2, wherein:

the casing is provided with a discharge pipe through which fluid discharged from the compression mechanism is led out to the outside of the casing from the second space; and the oil return passageway has a terminating end which is so positioned as to inhibit lubricating oil leaving the terminating end from flowing into the discharge pipe.

11. The fluid machine of claim 2, wherein:

in the inside of the casing the expansion mechanism is arranged above the compression mechanism;

a discharge pipe, through which fluid discharged from the compression mechanism is led out to the outside of the casing from the second space, is arranged between the compression mechanism and the expansion mechanism in the casing; and the oil return passageway has a terminating end which is positioned below a starting end of the discharge pipe.

12. The fluid machine of claim 2, wherein:

an electric motor, coupled to the rotating shaft to drive the compression mechanism, is arranged between the compression mechanism and the expansion mechanism in the casing;

a discharge pipe, through which fluid discharged from the compression mechanism is led out to the outside of the casing from the second space, is arranged between the electric motor and the expansion mechanism in the casing; and the oil return passageway has a terminating end which is positioned in a clearance defined between a core cut part formed in the outer periphery of a stator of the electric motor and the casing.

* * * * *

UNITED STATES PATENT AND TRADEMARK OFFICE

CERTIFICATE OF CORRECTION

PATENT NO. : 7,628,592 B2
APPLICATION NO. : 10/592803
DATED : December 8, 2009
INVENTOR(S) : Okamoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 562 days.

Signed and Sealed this

Second Day of November, 2010

David J. Kappos

David J. Kappos
*Director of the United States Patent and Trademark Office*